US006095630A

United States Patent [19]

Horii et al.

[11] Patent Number: 6,095,630

[45] Date of Patent: Aug. 1, 2000

[54] INK-JET PRINTER AND DRIVE METHOD OF RECORDING HEAD FOR INK-JET PRINTER

[75] Inventors: Shinichi Horii; Kenji Suzuki; Yuji Yakura; Tooru Tanikawa; Yuichiro Ikemoto, all of Kanagawa; Hiroshi Tokunaga, Tokyo, all of Japan

[73] Assignee: Sony Corporation, Tokyo, Japan

[21] Appl. No.: 09/108,033

[22] Filed: Jun. 30, 1998

[30] Foreign Application Priority Data

Jul. 2, 1997 [JP] Japan ..... 9-177479
Jul. 2, 1997 [JP] Japan ..... 9-177480
Jul. 2, 1997 [JP] Japan ..... 9-177481

[51] Int. Cl.[7] ..... B41J 29/38
[52] U.S. Cl. ..... 347/10; 347/11
[58] Field of Search ..... 347/9–12, 68

[56] References Cited

U.S. PATENT DOCUMENTS 4,646,106 2/1987 Howkins ..... 347/9
5,689,291 11/1997 Tence et al. ..... 347/10
5,933,168 8/1999 Sakai ..... 347/70

FOREIGN PATENT DOCUMENTS 55-017589 2/1980 Japan .
59-143652 8/1984 Japan .
02006137 1/1990 Japan .
05016359 1/1993 Japan .
08267739 10/1996 Japan .

*Primary Examiner*—John Barlow
*Assistant Examiner*—Craig A. Hallacher
*Attorney, Agent, or Firm*—Jay H. Maioli

[57] ABSTRACT

An ink-jet printer and a drive method for driving a recording head of an ink-jet printer are provided for controlling a size and a velocity of an ejected ink droplet. The ink-jet printer includes a droplet outlet orifice through which an ink droplet is ejected, an ink chamber communicating with the outlet orifice, an ink feed duct for feeding ink to the ink chamber, and a piezoelectric element for expanding and contracting the ink chamber in response to an applied voltage. A process for ink ejection includes a first step in which a meniscus in the outlet orifice is retracted towards the ink chamber by expanding the ink chamber, a second step in which the meniscus is moved towards the orifice by filling the chamber with ink, and a third step in which an ink droplet is ejected by contracting the ink chamber. The size and the velocity of the ink droplet ejected in the third step are controlled by controlling a position and a velocity of periodic travel of the meniscus at a start point of the third step.

27 Claims, 24 Drawing Sheets

| | t2 | meniscus position | droplet diameter |
|---|---|---|---|
| ① | 32 μ sec | | 40.0 μ m |
| ② | 16 μ sec | | 34.4 μ m |
| ③ | 4 μ sec | | 22.4 μ m |

retraction start
retraction complete
(nozzle edge) 0
time meniscus position
retraction direction
ejection direction
(+)
meniscus velocity 0
time
P1
P2
(2 π)
P3
(4 π)
P4
(6 π)
P5
P6
P7
(-)
retraction direction
droplet velocity Q1
Q2
Q3
Q4
Q5
Q6
Q7
0
start timing of third step retraction start
retraction complete
time
meniscus position
0
R1
R8
R9
R2
R10
R11
R3
R12
R13
R4
retraction direction ejection direction
(+)
meniscus velocity
0
(-)
retraction direction
P1
P2
(2 π)
P3
(4 π)
P4
(6 π)
P5
P6
P7
P8
P9
P10
P11
P12
P13
time droplet velocity
0
Q1
Q2
Q3
Q4
Q5
Q6
Q7
Q8
start timing of third step droplet size
0
S1
S2
S3
S4
S8
start timing of third step

INK-JET PRINTER AND DRIVE METHOD OF RECORDING HEAD FOR INK-JET PRINTER

BACKGROUND OF THE INVENTION

1. Field of the Invention

The present invention relates to an ink-jet printer for ejecting ink droplets through a droplet outlet orifice (a nozzle) and recording on paper and a method of driving a recording head for an ink-jet printer.

2. Description of the Related Art

Ink-jet printers for ejecting ink droplets through a droplet outlet orifice communicating with an ink chamber and recording on paper have been widely used. For such printers methods have been developed for stably reducing a droplet size so as to achieve higher resolution and for varying a droplet size dot by dot so as to produce a gray-scale image and so on.

One of the methods for reducing a droplet size is expanding an ink chamber for retracting a position of extremity of ink called meniscus inside a droplet outlet orifice towards the chamber and contracting the chamber before the meniscus return to the previous position so as to eject an ink droplet through the orifice.

For example, in Japanese Patent Application Laid-open No. 55-17589 (1980), a method is disclosed for ejecting an ink droplet through the step of increasing an ink chamber volume from an initial state and restoring the initial state. It is disclosed therein that a droplet diameter is varied with a change in displacement (an amount of increase in the ink chamber volume) in an intake step.

In another example as disclosed in Japanese Patent Application Laid-open No. 2-6137 (1990), a droplet size is controlled by changing a voltage applied for reducing the pressure inside an ink chamber and for restoring an initial state.

In Japanese Patent Application Laid-open No. 59-143652 (1984), a method is disclosed for controlling a droplet size by applying an auxiliary pulse before a primary pulse for droplet ejection for changing a meniscus position in a droplet outlet orifice.

In Japanese Patent Application Laid-open No. 5-16359 (1993), a method is disclosed for controlling a droplet size by applying an auxiliary pulse and then a primary pulse in synchronous with a residual pressure wave in an ink chamber.

In such ink-jet printers, a recording head ejects droplets while traveling in the direction orthogonal to the direction in which paper is carried. Therefore, if velocities of ejected droplets vary, positions in which the droplets land vary as well. The quality of image recorded is thereby significantly degraded. It is thus important to maintain a velocity of ejected droplets constant for achieving a high quality recorded image.

A recording head is usually controlled through the use of a head carriage drive motor and the like so as to reciprocate at a constant speed. However, speed variations due to mechanical factors and a shift in distance between the recording head and a landing point of droplet may occur. In these cases errors are produced in landing points of droplets ejected from the recording head. These errors may reduce the quality of image reproduction. It is therefore desirable that a velocity of ejected droplet is controlled so as to compensate the factors for such errors.

In such a recording head in general, as described above, the ink chamber is expanded so as to retract the meniscus position inside the nozzle towards the chamber and then contracting the chamber to eject a droplet. In this case oscillations called Helmholtz natural oscillations are produced in the chamber by driving piezoelectric diaphragm. The meniscus position retracted towards the chamber is oscillated as well at the frequency of the natural oscillations. Accordingly, timing of ink chamber contraction greatly affects not only a droplet size but also a velocity of ejected droplet. Methods of driving a recording head less susceptible to such natural oscillations have been therefore developed.

In U.S. Pat. No. 4,646,106, for example, a drive method is disclosed wherein an ink chamber is contracted for ejecting a droplet at the instant when the meniscus position is retracted to the deepest position.

Another example disclosed in Japanese Patent Application Laid-open No. 8-267739 (1996) is an ink-jet recording apparatus for ejecting a droplet within time which is two thirds of natural oscillation frequency of the meniscus.

However, in Japanese Patent Application Laid-open No. 55-17589 (1980) mentioned above, it is only disclosed that a droplet size is changeable by varying an amount of displacement in the intake step while no specific drive method is described for controlling a droplet size. It is therefore difficult to precisely control a droplet size.

The method disclosed in Japanese Patent Application Laid-open No. 2-6137 (1990) is controlling a droplet size by changing a voltage applied for reducing the pressure inside an ink chamber and for restoring an initial state. However, no explanation is given to control of meniscus retraction position considering ink feed. Precise control of droplet size is practically difficult.

The methods disclosed in Patent Application Laid-open Nos. 59-143652 (1984) and 5-16359 (1995) are both applying a primary pulse after controlling the meniscus position in the nozzle with an auxiliary pulse. Therefore both methods require an auxiliary pulse. In the methods the meniscus position changes depending on the width and height of the auxiliary pulse and the time interval between the auxiliary pulse and the primary pulse. It is therefore required to adjust the plurality of parameters. Furthermore, in the former publication, the relationship between the auxiliary pulse and droplet size is not clearly described. In the latter publication, although the relationship between the droplet size and the variation cycle of meniscus position is described, no specific explanation is given to the relationship between the droplet size and the meniscus position retracted into the nozzle. Precise control of droplet size through these methods is therefore practically difficult.

As thus described, precise control of droplet size is difficult with ink-jet printers of related art. It is therefore difficult to achieve higher resolution and high quality image representation of halftone.

In the methods disclosed in U.S. Pat. No. 4,646,106 and Japanese Patent Application Laid-open No. 8-267739 (1996), although the natural oscillations of meniscus are considered, the velocity of meniscus changing the position and the phase of meniscus are not taken into account. It is therefore difficult to precisely control the velocity of ejected droplet at a constant value. Furthermore, since the methods are provided for ejection within a limited range of natural oscillations of meniscus, the velocity obtained is thereby limited. It is therefore difficult to control the velocity as desired.

It is also difficult to control both droplet size and velocity such as controlling image density and gradation while compensating a shift in droplet landing position due to unstable velocity of the recording head as described above.

SUMMARY OF THE INVENTION

It is an object of the invention to provide an ink-jet printer and a method of driving a recording head for an ink-jet printer for precisely controlling a size and a velocity of ink droplet ejected.

An ink-jet printer of the invention comprises: a droplet outlet orifice through which an ink droplet is ejected; an ink chamber communicating with the outlet orifice; an ink feed duct for feeding ink to the ink chamber; a piezoelectric element for expanding and contracting the ink chamber in response to an applied voltage; and a step control means for controlling a first step for retracting an extremity of ink exposed to the outside through the outlet orifice towards the ink chamber by expanding the ink chamber with the piezoelectric element; a second step for having the ink extremity move towards the outlet orifice by feeding ink to the ink chamber through the ink feed duct; and a third step for having an ink droplet ejected through the outlet orifice by contracting the ink chamber with the piezoelectric element. The step control means controls a size of the ink droplet ejected in the third step by controlling a position of the ink extremity at a start point of the third step through changing at least either an amount of retraction of the ink extremity in the first step or time required for the second step. The droplet size may be controlled by the step control means further controlling the amount of contraction of the ink chamber in the third step.

A method of the invention is provided for driving a recording head for an ink-jet printer comprising a droplet outlet orifice through which an ink droplet is ejected; an ink chamber communicating with the outlet orifice; an ink duct for feeding ink to the ink chamber; a piezoelectric element for expanding and contracting the ink chamber in response to an applied voltage. The method includes: a first step for retracting an extremity of ink exposed to the outside through the outlet orifice towards the ink chamber by expanding the ink chamber with the piezoelectric element; a second step for having the ink extremity move towards the outlet orifice by feeding ink to the ink chamber through the ink feed duct; and a third step for having an ink droplet ejected through the outlet orifice by contracting the ink chamber with the piezoelectric element. A size of the ink droplet ejected in the third step is controlled by controlling a position of the ink extremity at a start point of the third step through changing at least either an amount of retraction of the ink extremity in the first step or time required for the second step. The droplet size may be controlled by further controlling the amount of contraction of the ink chamber in the third step.

According to the ink-jet printer and the method of the invention, the position of the ink extremity at the start point of the third step, that is, the start point of ejection is adjustable (selectable) by changing at least either an amount of retraction of the ink extremity in the first step or time required for the second step. To be specific, the position of the ink extremity at the start point of the third step is controllable by any of changing the amount of retraction of the ink extremity in the first step while maintaining time required for the second step constant; changing time required for the second step while maintaining the amount of retraction of the ink extremity in the first step constant; and changing both amount of retraction of the ink extremity in the first step and time required for the second step. The size of the ink droplet ejected is thereby controlled. In particular, the droplet size is kept constant if the ink extremity position at the start point of the third step is constant.

Another ink-jet printer of the invention comprises: a droplet outlet orifice through which an ink droplet is ejected; an ink chamber communicating with the outlet orifice; an ink feed duct for feeding ink to the ink chamber; a piezoelectric element for expanding and contracting the ink chamber in response to an applied voltage; and a step control means for controlling a first step for retracting an extremity of ink exposed to the outside through the outlet orifice towards the ink chamber by expanding the ink chamber with the piezoelectric element; a second step for having the ink extremity move towards the outlet orifice by feeding ink to the ink chamber through the ink feed duct; and a third step for having an ink droplet ejected through the outlet orifice by contracting the ink chamber with the piezoelectric element. The step control means controls a velocity of the ink droplet ejected in the third step by controlling a velocity of periodic travel of the ink extremity at a start point of the third step. The droplet velocity may be controlled by the step control means further controlling the contraction speed of the ink chamber in the third step.

Another method of the invention is provided for driving a recording head for an ink-jet printer comprising a droplet outlet orifice through which an ink droplet is ejected; an ink chamber communicating with the outlet orifice; an ink duct for feeding ink to the ink chamber; a piezoelectric element for expanding and contracting the ink chamber in response to an applied voltage. The method includes: a first step for retracting an extremity of ink exposed to the outside through the outlet orifice towards the ink chamber by expanding the ink chamber with the piezoelectric element; a second step for having the ink extremity move towards the outlet orifice by feeding ink to the ink chamber through the ink feed duct; and a third step for having an ink droplet ejected through the outlet orifice by contracting the ink chamber with the piezoelectric element. A velocity of the ink droplet ejected in the third step is controlled by controlling a velocity of periodic travel of the ink extremity at a start point of the third step. The droplet velocity may be controlled by further controlling the contraction speed of the ink chamber in the third step.

According to the ink-jet printer and the method of the invention, the velocity of ejected ink droplet is controlled by changing the velocity of periodic travel of the ink extremity at the start point of the third step, that is, the start point of ejection to various values. The velocity of periodic travel of the ink extremity at the start point of the third step is controllable by changing at least either the amount of retraction of the ink extremity in the first step or time required for the second step, for example. To be specific, the velocity of periodic travel of the ink extremity at the start point of the third step is controllable by any of changing the amount of retraction of the ink extremity in the first step while maintaining time required for the second step constant; changing time required for the second step while maintaining the amount of retraction of the ink extremity in the first step constant; and changing both amount of retraction of the ink extremity in the first step and time required for the second step. In particular, the droplet velocity is kept constant if step control is performed such that the velocity of periodic travel of ink extremity at the start point of the third step is constant. The velocity of periodic travel of ink extremity at the start point of the third step is determined by the phase of periodic travel of ink extremity at the start point of the third step, for example. Therefore, the velocity of periodic travel of ink extremity at the start point of the third step is kept constant by controlling so as to keep the phase constant. As a result, the droplet velocity is kept constant.

Still another ink-jet printer of the invention comprises: a droplet outlet orifice through which an ink droplet is ejected; an ink chamber communicating with the outlet orifice; an ink feed duct for feeding ink to the ink chamber; a piezoelectric element for expanding and contracting the ink chamber in response to an applied voltage; and a step control means for controlling a first step for retracting an extremity of ink exposed to the outside through the outlet orifice towards the ink chamber by expanding the ink chamber with the piezoelectric element; a second step for having the ink extremity move towards the outlet orifice by feeding ink to the ink chamber through the ink feed duct; and a third step for having an ink droplet ejected through the outlet orifice by contracting the ink chamber with the piezoelectric element. The step control means controls a size and velocity of the ink droplet ejected in the third step by controlling a position and velocity of periodic travel of the ink extremity at a start point of the third step.

According to the ink-jet printer of the invention, the droplet size and velocity are controlled by changing the position and velocity of periodic travel of the ink extremity at the start point of the third step, that is, the start point of ejection to various values.

Other and further objects, features and advantages of the invention will appear more fully from the following description.

DETAILED DESCRIPTION OF THE PREFERRED EMBODIMENTS

Preferred embodiments of the invention will now be described in detail with reference to the accompanying drawings.

Figure 1:
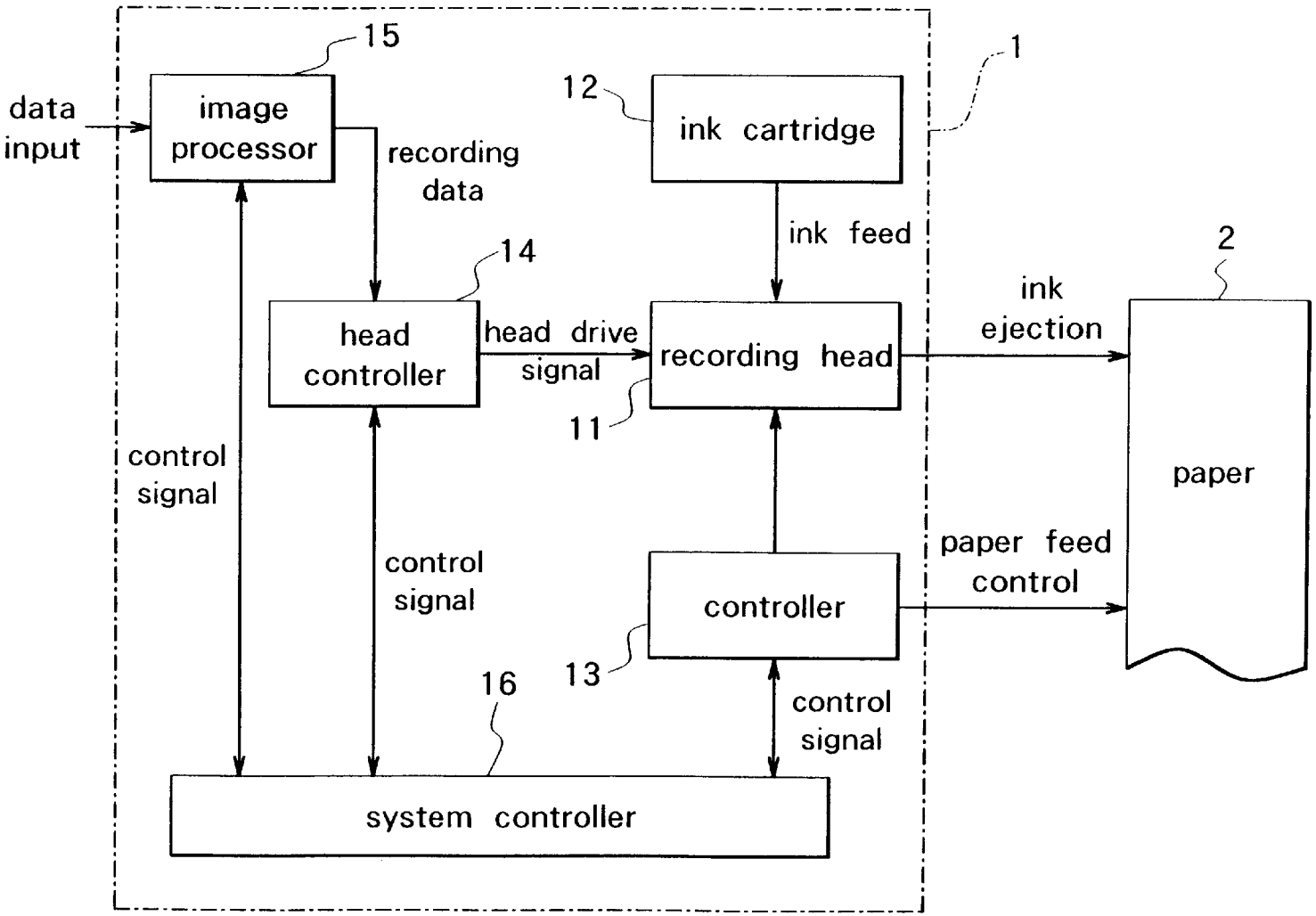
FIG. 1 is a schematic diagram for illustrating the main part of an ink-jet printer of a first embodiment of the invention.

FIG. 1 is a schematic diagram for illustrating the main part of an ink-jet printer of a first embodiment of the invention. A method of driving a recording head of an ink-jet printer of the embodiment which is implemented with the ink-jet printer of the embodiment will be described as well.

An ink-jet printer 1 comprises: a recording head 11 for recording on recording paper 2 through ejecting ink droplets thereon; an ink cartridge 12 for feeding ink to the recording head 11; a controller 13 for controlling the position of the recording head 11 and feeding of the paper 2; a head controller 14 for controlling droplet ejection of the recording head 11 with a head drive signal; an image processor 15 for performing a specific image processing on input image data and supplying the data as recording data to the head controller 14; and a system controller 16 for controlling the controller 13, the head controller 14 and the image processor 15. The head controller 14 corresponds to a step control means of the invention.

Figure 2:
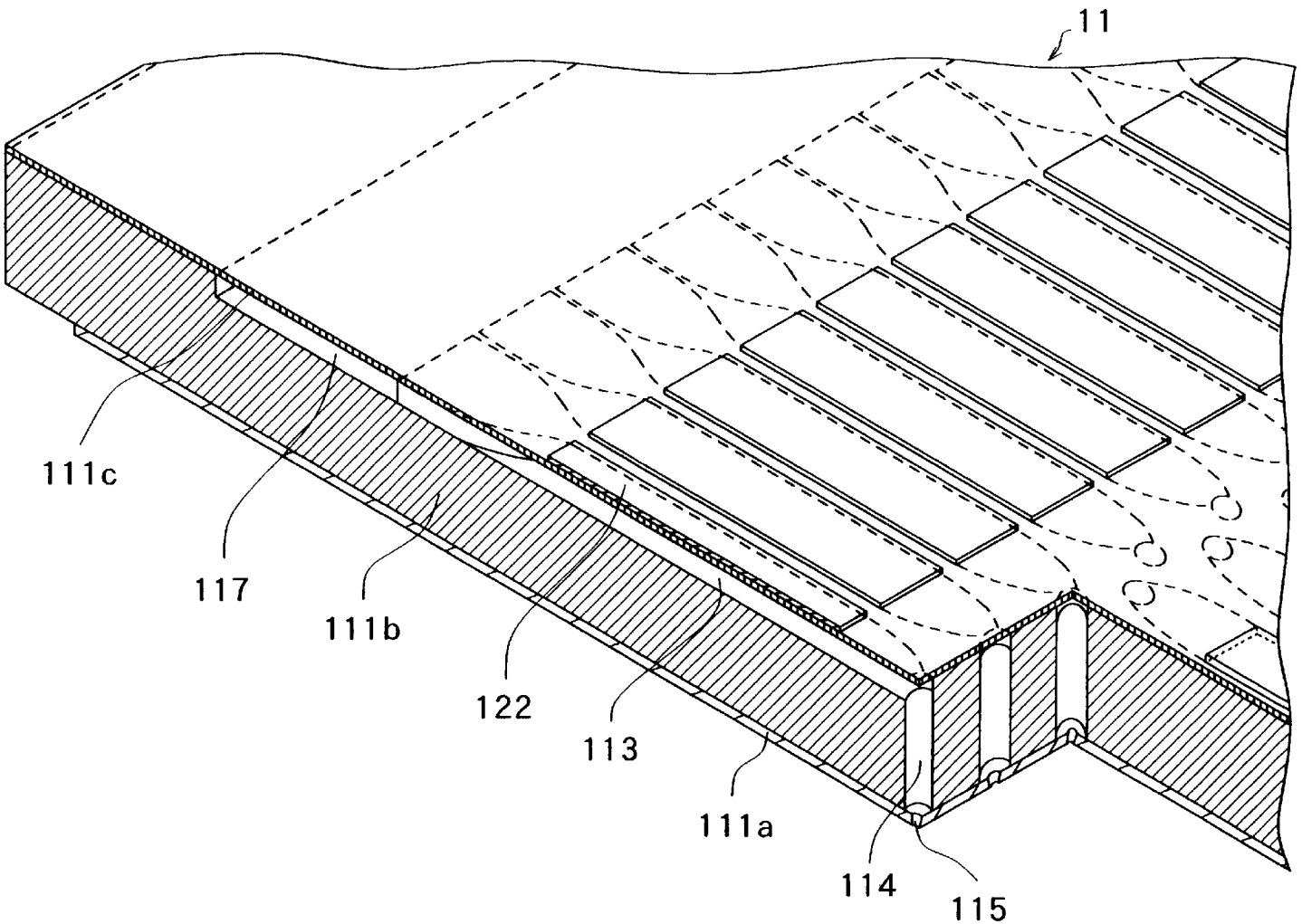
FIG. 2 is a perspective cross section of an example of recording head.
Figure 3:
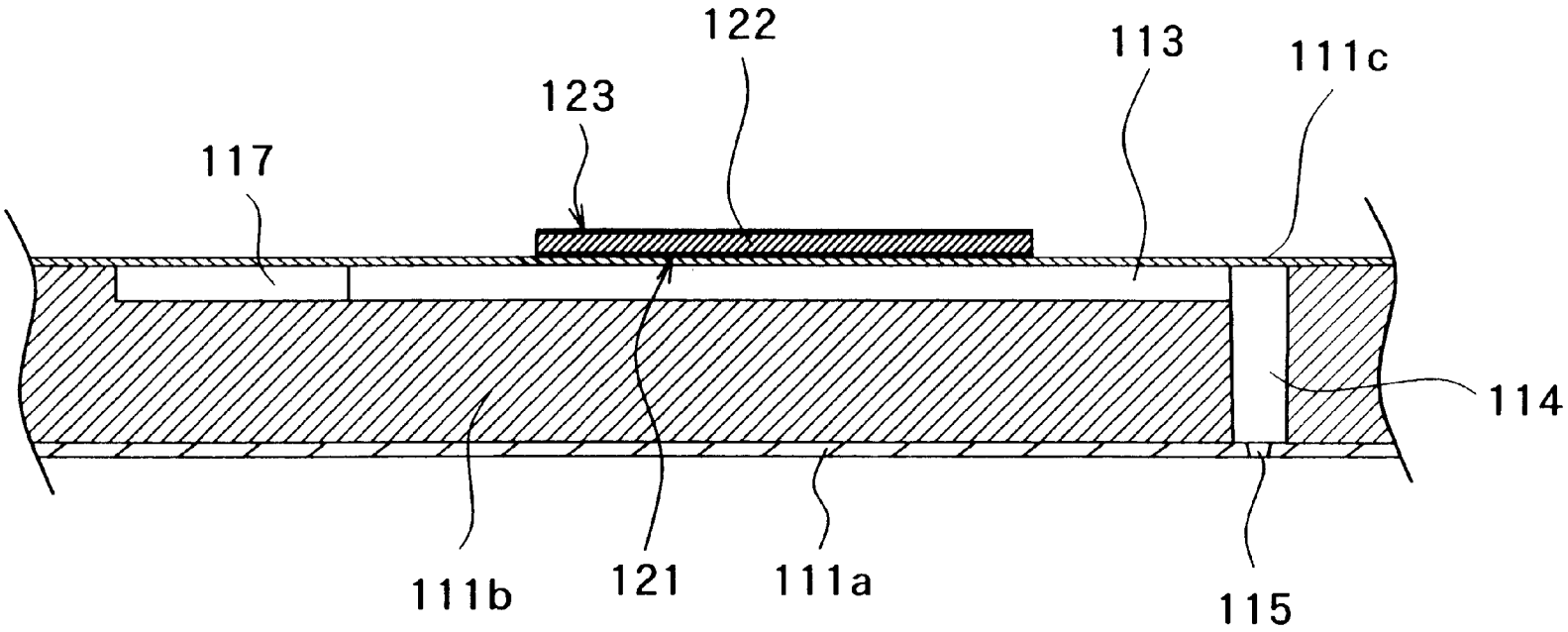
FIG. 3 is a cross section of the recording head.

FIG. 2 is a perspective cross section of the recording head 11 in FIG. 1. FIG. 3 is a cross section of the recording head 11 in FIG. 2. As shown, the recording head 11 comprises a nozzle plate 111*a*, a duct plate 111*b* and an oscillation plate 111*c* stacked in this order. The plates 111*a* to 111*c* are made of glass or stainless steel, for example. The plates 111*a* to 111*c* are bonded to each other with an adhesive not shown or through melting glass to be crimped, for example. The plates 111*a* to 111*c* may be formed in one piece.

Ink chambers 113 are formed in the duct plate 111*b*. Each ink chamber 113 communicates with ducts 114. A nozzle 115 communicating with each duct 114 is formed in the nozzle plate 111*a*. An ink droplet is ejected through the nozzle 115. The ink chamber 113 corresponds to an 'ink chamber' of the invention. An extremity of the nozzle 115 corresponds to a 'droplet outlet orifice' of the invention.

A shared duct 117 is formed in the duct plate 111*b*. The shared duct 117 communicates with the ink cartridge 12 in FIG. 1 (not shown in FIG. 2 and FIG. 3) to be provided with ink. The shared duct 117 corresponds to an 'ink feed duct' of the invention.

As shown in FIG. 3, a lower electrode 121, a piezoelectric element 122 and an upper electrode 123 are stacked over a region of the oscillation plate 111*c* corresponding to the ink chamber 113. A voltage is applied between the lower electrode 121 and the upper electrode 123, corresponding to a head drive signal inputted from the head controller 14 in FIG. 1. The piezoelectric element 122 is thereby bent so as to increase (expand) and reduce (contract) the volume of the ink chamber 113. The piezoelectric element 122 corresponds to a 'piezoelectric element' of the invention.

The recording head 11 has a plurality of nozzles 115 in a row at even intervals. A set of the duct 114 and the ink chamber 113 is provided for each nozzle 115. Ink is regularly fed into each ink chamber 113 at a constant speed from the ink cartridge 12 (FIG. 1) through the shared duct 117 and the duct 114. Such ink feed may be performed by capillarity. Alternatively, a pressure mechanism may be provided for feeding ink by applying a pressure to the ink cartridge 12. By a carriage drive motor and an associated carriage mechanism not shown, the recording head 11 is reciprocated in the direction orthogonal to the direction in which the paper 2 is carried while ejecting ink droplets. An image is thereby recorded on the paper 2.

Figure 4:
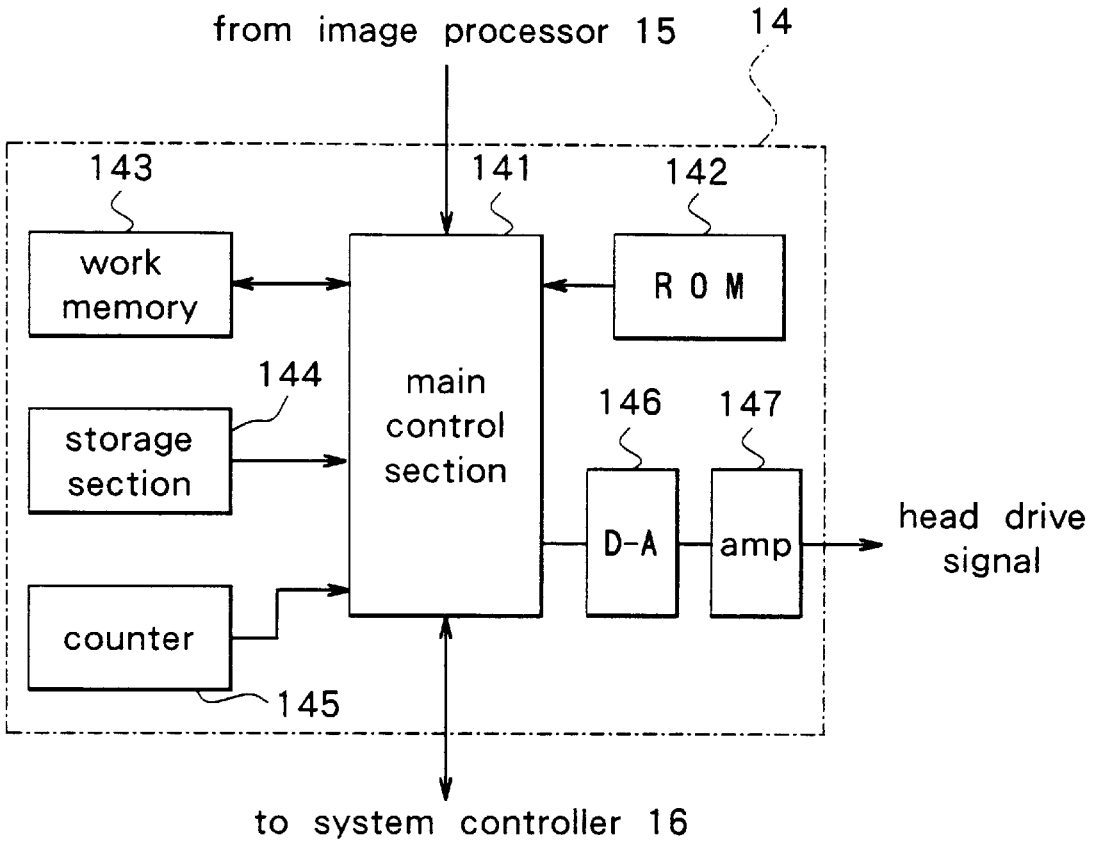
FIG. 4 is a block diagram of an example of head controller.

FIG. 4 is a block diagram of the head controller 14 in FIG. 1. As shown, the head controller 14 comprises: a main control section 141 made up of a microprocessor and the like for controlling the entire head controller 14; read only memory (ROM) 142 for storing a program executed by the main control section 141; work memory 143 made up of random access memory (RAM) and the like and used for particular computations performed by the main control section 141 and temporary data storage; a storage section 144 made up of nonvolatile memory for storing drive voltage waveforms; a counter 145 having a timer function; a digital-to-analog (D-A) converter 146 for converting digital data read from the storage section 144 into analog data; and an amplifier 147 for amplifying an output of the D-A converter 146 to be outputted as a head drive signal.

The storage section 144 is provided for storing data indicating voltage waveforms of head drive signals for driving the recording head 11 (the data is called waveform data in the following description). Waveform data includes drive voltage waveforms in various forms corresponding to ink droplet sizes for forming pixel dots. To be specific, the drive voltage waveform is a digitized waveform of voltage applied between the lower electrode 121 and the upper electrode 123 for driving the piezoelectric element 122 (waveform A to E in FIG. 5A described below). Although only one head drive signal outputted from the head controller 14 is shown in FIG. 4, a plurality of head drive signals are outputted in a parallel manner in practice. The number of signals corresponds to the number of the nozzles 115, that is, the number of piezoelectric elements 122 in FIG. 2.

The counter 145 is reset with an ejection timing clock (not shown) inputted from the system controller 16 as a reference clock for operation timing of the ink-jet printer of the embodiment. The counter 145 starts counting at the instant of the reset and outputs an expiration signal to the main control section 141 after a duration of time determined by the waveform data mentioned above. The expiration signal functions as a start trigger for a first step described below.

Operations of the ink-jet printer described so far will now be described.

Figures 5A, 5B, 5C:
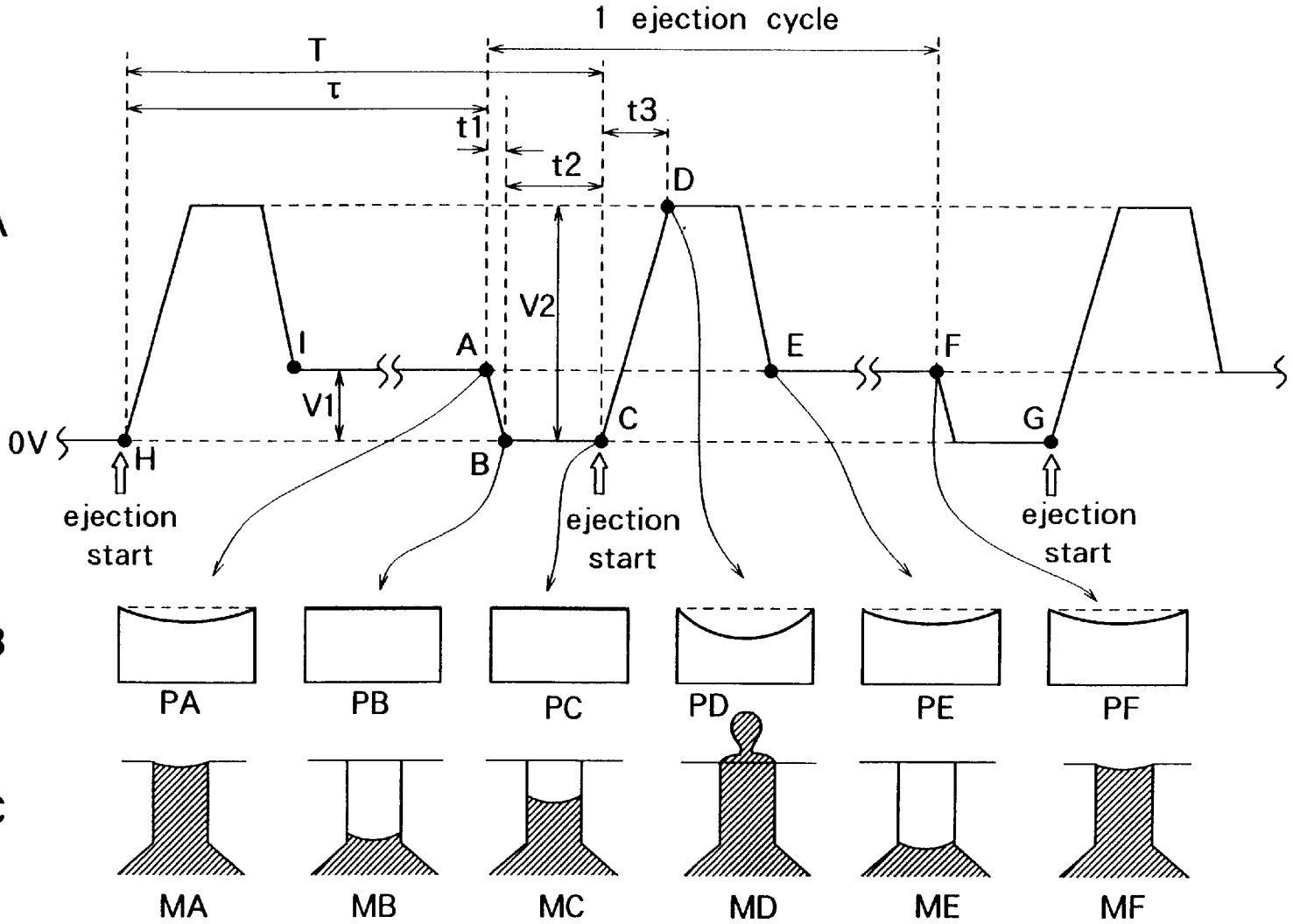
FIG. 5A to FIG. 5C show an example of operation of recording head.

Reference is made to FIG. 5A to FIG. 5C for describing a fundamental operation of the recording head 11. FIG. 5A shows an example of waveform of drive voltage applied between the lower electrode 121 and the upper electrode 123 of the recording head 11. FIG. 5B illustrates the status of the ink chamber 113 at main points A to F in the drive voltage waveform. FIG. 5C illustrates the status of the nozzle 115 at points A to F. The nozzle 115 is directed upward in FIG. 5C for convenience in description.

Three steps in operation of the recording head 11 will now be defined. A first step is the step in which a drive voltage is changed from first voltage V1 to voltage 0 (from A to B). Time required for the first step is defined as t1. A second step is the step in which voltage 0 is maintained (from B to C). Time required for the second step is defined as t2. A third step is the step in which voltage 0 is changed to second voltage V2 (from C to D). Time required for the third step is defined as t3. In the following description, first voltage V1 is called retraction voltage. Second voltage V2 is called ejection voltage. T3 required for the third step and ejection voltage V2 are each maintained at a constant value in the first embodiment.

The recording head 11 is driven at a constant frequency (of the order of 1 to 10 kHz). Timing cycle T of ink droplet ejection, that is, the cycle of ejection timing clock is determined, depending on the drive frequency. Points H, C and G at which the third step is started are synchronized with the ejection timing clock mentioned above. The first and second steps precede each ejection timing clock.

At and before point A, as $P_A$ in FIG. 5B, the oscillation plate 111*c* is slightly bent inward with an application of voltage V1 to the piezoelectric element 122 and remains at rest. The ink chamber 113 is thereby in a state of contraction. At point A, as $M_A$ in FIG. 5C, the meniscus position in the nozzle 115 is equal to the edge of the nozzle 115 (referred to as nozzle edge in the following description).

Next, the first step is performed for reducing the drive voltage from voltage V1 at point A to voltage 0 at point B. The voltage applied to the piezoelectric element 122 is thereby reduced to zero so that the bent in the oscillation plate 112*c* is eliminated and the ink chamber 113 is expanded as $P_B$ in FIG. 5B. Consequently, the meniscus in the nozzle 115 is retracted towards the ink chamber 113. At point B the meniscus is retracted as deep as $M_B$ in FIG. 5C, that is, moves away from the nozzle edge.

As described later, the amount of retraction of the meniscus in the first step is changed by changing retraction voltage V1, that is, potential difference V1 between points A and B. Therefore it is consequentially possible to adjust the meniscus position at the point of completion of the second step, that is, at the start point of the third step. The meniscus position, that is, the distance between the nozzle edge and the meniscus has a significant effect on a droplet size ejected in the third step. The droplet size is thus controlled by adjusting the meniscus position. That is, it is possible to control the droplet size by changing the amount of retraction of the meniscus in the first step. Although time t1 required for the first step is fixed to an adequate value in the embodiment, time t1 may be variable if necessary.

Next, the second step is performed for maintaining the volume of the ink chamber 113 by fixing the drive voltage to zero so as to keep the oscillation plate 111*c* unbent during time t2 from point B to point C. During time t2 ink is continuously fed from the ink cartridge 12. The meniscus position in the nozzle 115 is thus shifted towards the nozzle edge. The meniscus position proceeds as far as the state of $M_C$ shown in FIG. 5C.

As will be described in a second embodiment, the amount of movement of the meniscus may be varied by changing time t2 in the second step. The meniscus position at the start point of the third step is thereby adjusted. That is, the droplet size is controllable by adjusting time t2.

Next, the third step is performed for abruptly increasing the drive voltage from voltage 0 at point C to ejection voltage V2 at point D. Point C synchronizes with the ejection timing pulse mentioned above (not shown). Since high ejection voltage V2 is applied to the piezoelectric element 122 at point D, the oscillation plate 111*c* is greatly bent inward as $P_D$ in FIG. 5B. The ink chamber 113 is thereby abruptly contracted. Consequently, as $M_D$ in FIG. 5C, the meniscus in the nozzle 115 is pressed towards the nozzle edge at a stretch through which an ink droplet is ejected. The droplet ejected flies in the air and lands on the paper 2.

Next, the drive voltage is reduced to V1 again so that the oscillation plate 111*c* is slightly bent inward to be in the initial status ($P_E$ in FIG. 5B). This status is maintained until point F at which the first step of next ejection cycle is started. At point E immediately after the drive voltage is reduced to V1 again, as $M_E$ in FIG. 5C, the meniscus position is retreated by the amount nearly corresponding to the amount of ink ejected. With ink refilling, the meniscus position returns to the position of the nozzle edge, as $M_F$ in FIG. 5C, at point F at which the first step of next ejection cycle is started. This status is similar to $M_A$ at point A.

The cycle of ejection is thus completed. Such a cycle of operation is repeated for each of the nozzles 115 in a parallel manner. Image recording on the paper 2 is thereby continuously performed.

Figure 6:
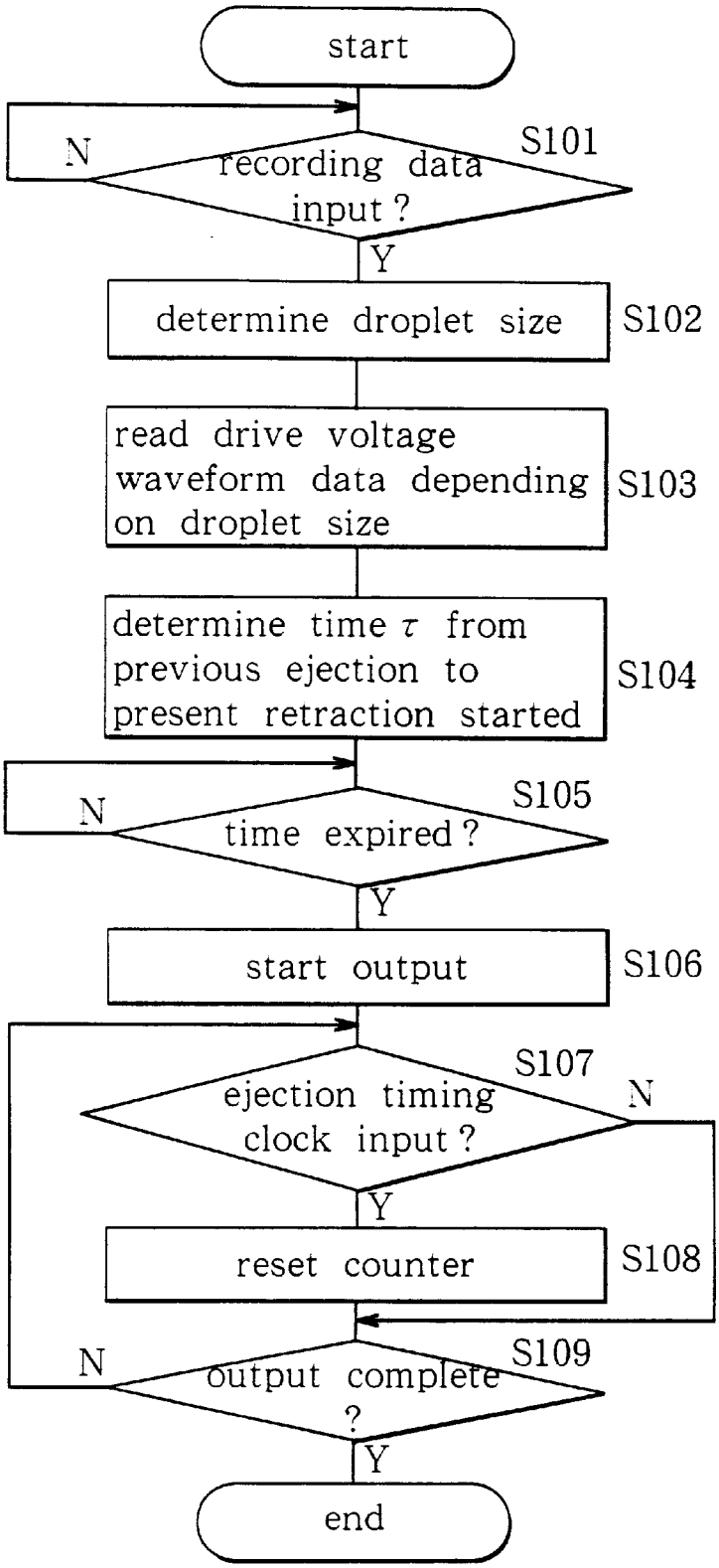
FIG. 6 is a flowchart for illustrating the operation of main control unit of the head controller.

Reference is now made to FIG. 6 for describing the operation of the ink-jet printer 1 as a whole. FIG. 6 shows the main operation of one ejection cycle in the head controller 14 in FIG. 1. In this description the counter 145 (FIG. 4) in the head controller 14 is already reset in the immediately preceding ejection cycle. Voltage V1 at point I (FIG. 5) at which ejection is completed in the immediately preceding cycle is maintained until a head drive signal is outputted in step S106 in FIG. 6.

In FIG. 1 printing data is inputted to the ink-jet printer 1 from an information processing apparatus such as a personal computer. The image processor 15 performs specific image processing on the input data (such as expansion of compressed data) and outputs the data as recording data to the head controller 14.

On receipt of the recording data (Y in step S101 in FIG. 6), the main control section 141 (FIG. 4) in the head controller 14 determines (selects) an ink droplet size for forming a specific dot based on the data (step S102). For example, a large size is selected for representing high density and a small size for representing low density or high resolution. For representing a natural image or an image with density gradient, a droplet size different from neighboring dots is selected if necessary.

Next, the main control section 141 reads drive voltage waveform data corresponding to the selected droplet size from the storage section 144 (step S103). As described with reference to FIG. 4, waveform data in various forms corresponding to droplet sizes is stored in the storage section 144. In the embodiment, waveform data having retraction voltage V1 corresponding to the selected droplet size is read for each dot when the droplet size is changed for each dot as mentioned above. In order to control the droplet size to be a constant size, one type of predetermined waveform data is only read repeatedly for every dot.

Next, the main control section 141 determines time $\tau$ between point H at which the third step in the previous cycle is started (that is, the point of ejection at which the counter 145 is reset and counting is started) and point A at which retraction in the present cycle is started (the start point of the first step) based on the read waveform data (step S104). As shown in FIG. 5A, time $\tau$ is given by subtracting the sum of time required for the first and second steps (t1+t2) from interval T between ejections (the cycle of ejection timing clock). The operations in steps S101 to S104 described so far are performed in a short time between point I and point A in FIG. 5A. If voltage V1 in the waveform data read in the present cycle (that is, the voltage at point A) is different from the voltage at point I in the previous ejection cycle, the value of voltage V1 applied to the piezoelectric element 122 is changed to the value read in the present cycle and the value is maintained.

Next, the main control section 141 waits until time $\tau$ expires (step S105). Time $\tau$ having expired, an expiration signal is inputted from the counter 145 (Y in step S105). The main control section 141 then starts outputting the read waveform data (step S106). The waveform data is converted to an analog signal at the D-A converter 146 and amplified at the amplifier 147 to be supplied to the recording head 11 as a head drive signal with a waveform as A to E in FIG. 5A, for example. In the recording head 11, the three steps described with reference to FIG. 5A to FIG. 5C are performed based on the voltage waveform of the head drive signal. An ink droplet of the size as determined by the waveform data is thus ejected. In the period after point E preparation for next ejection cycle is performed, that is, the droplet size is determined and the waveform data is read and so on (steps S101 to S104). Such ejection and preparation for ejection are repeated.

After the head drive signal is started to be outputted in step S106, an ejection timing clock is inputted at point C at which the third step is started (Y in step S107). The counter 145 is reset and starts counting for next ejection cycle (step S108). The third step is completed at point D in FIG. 5A (step S109). Voltage V1 is maintained or changed as described above and maintained after the drive voltage is returned to V1 at point E until point F at the next ejection cycle is started. During this period the ink chamber 113 is refilled with ink to prepare for the next ejection. The one ejection cycle is thus completed.

Figure 7:
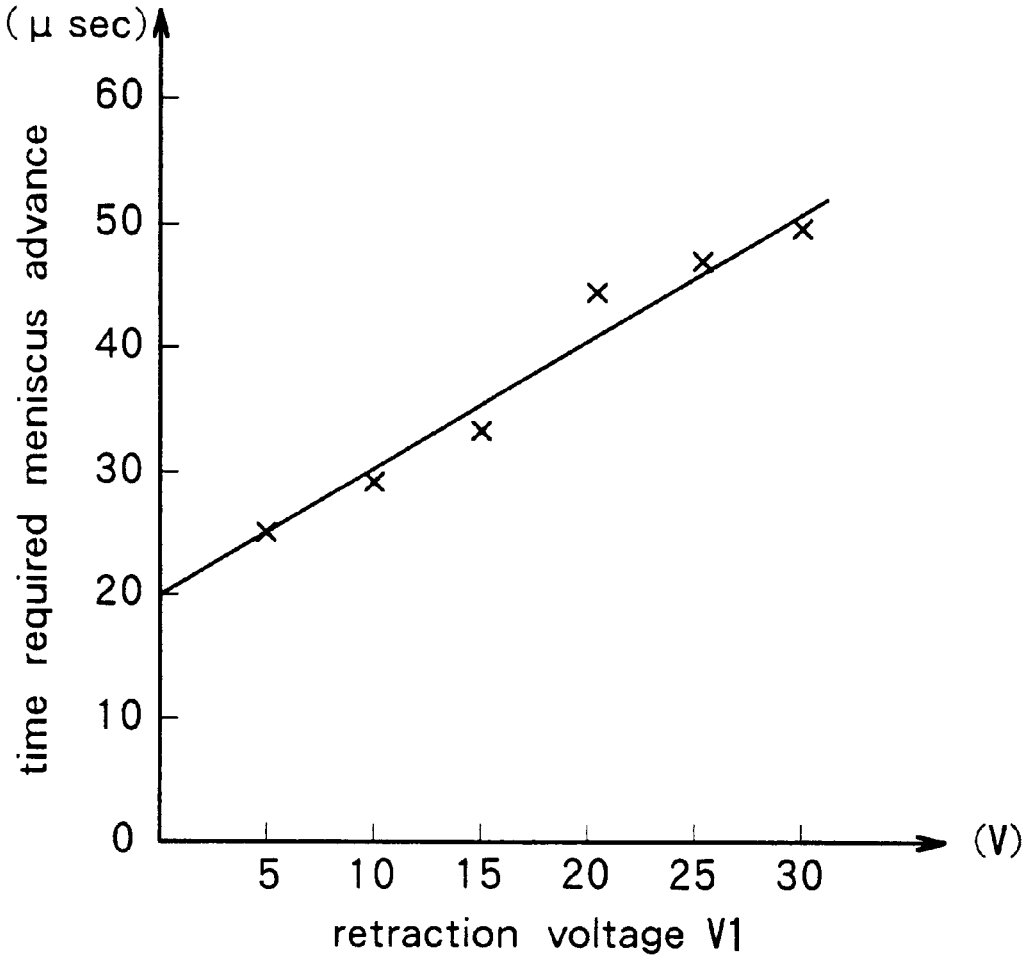
FIG. 7 shows a result of example of experiment for representing a relationship between a meniscus retraction voltage and time required for meniscus advance.

FIG. 7 shows a result of example of experiment for representing a relationship between voltage V1 for meniscus retraction and time required for meniscus advance. Time required for meniscus advance means the time required for the meniscus retracted in the nozzle 115 towards the ink chamber 113 with the retraction voltage moving towards the nozzle edge and reaching the edge of the nozzle 115. In FIG. 7 the horizontal axis indicates retraction voltage V1 in volt. The vertical axis indicates time required for meniscus advance in microsecond ($\mu$ sec). The experiment result is obtained wherein the time required for retraction, that is, time t1 required for the first step in FIG. 5A, is 14 $\mu$sec.

As shown, the increment of time required for advance increases in proportion to retraction voltage V1. Since the ink feed speed is considered constant, the meniscus position immediately after retraction is determined depending on retraction voltage V1, as shown in FIG. 7. This means that it is possible to adjust the meniscus position at the point of ejection (the start point of the third step) with the retraction voltage.

Figure 8A:
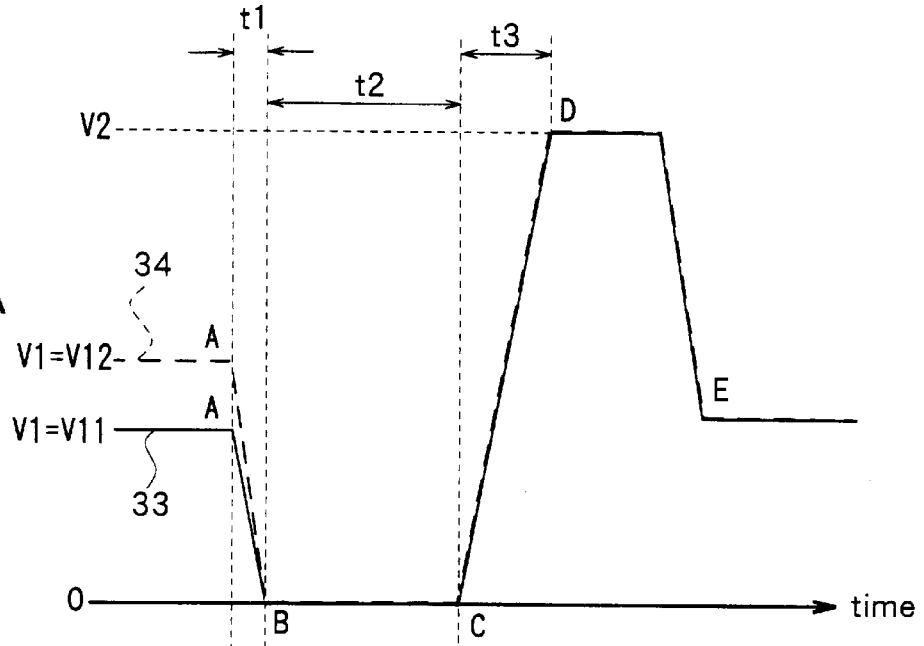
FIG. 8A and FIG. 8B show the shifts of meniscus when the retraction voltage in the first step is varied.
Figure 8B:
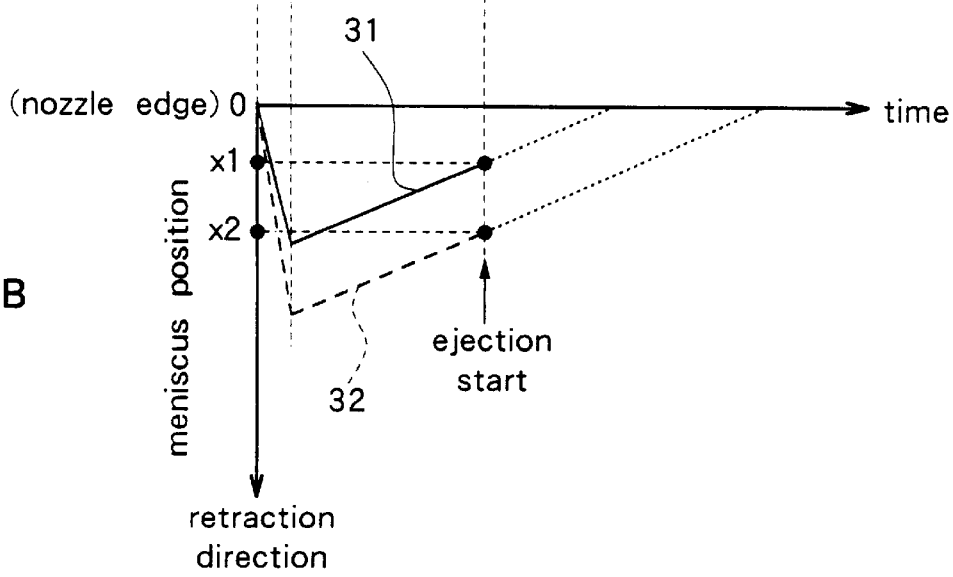

FIG. 8A and FIG. 8B show the shifts of meniscus position when retraction voltage V1 in the first step is varied while time t2 required for the second step is maintained constant. FIG. 8A shows the voltage waveform of the head drive signal wherein the horizontal axis indicates time and the vertical axis indicates voltage. FIG. 8B shows the shifts of meniscus position wherein the horizontal axis indicates time and the vertical axis indicates the meniscus position (the distance between the nozzle edge and the meniscus). A locus 31 of the meniscus position in solid line corresponds to a voltage waveform 33 wherein the retraction voltage is lower (V1=V11). A locus 32 of the meniscus position in broken line corresponds to a voltage waveform 34 wherein the retraction voltage is higher (V1=V12). In this description time t3 required for the third step and the magnitude of ejection voltage V2 are constant as described above. Time t1 required for the first step is constant as well, which may be variable if necessary.

As shown, the meniscus is deeply retracted with a higher retraction voltage. Since the ink feed speed is constant, the advance speeds of meniscus (the gradients of the loci 31 and 32 of the meniscus moving towards the nozzle edge in FIG. 8B) are equal. Therefore, if time t2 required for the second step is equal, the meniscus position at point C at which the third step is started is point x2 when the amount of retraction is greater, which is deeper than point x1 when the amount of retraction is smaller. That is, ejection is performed with the meniscus in a deeper position by retracting the meniscus more deeply. Since it is known that the deeper the meniscus position at ejection, the smaller the droplet size is, the droplet size is thus reduced by retracting the meniscus deeply. The droplet is changed to various sizes by changing retraction voltage V1 to various values.

In the embodiment as described so far, the three steps are performed for ink ejection, including the first step in which the meniscus is retracted with retraction voltage V1; the second step in which ink is fed while the drive voltage is maintained at zero and the meniscus position is adjusted to a desired position; and the third step in which ejection voltage V2 is applied when the meniscus reaches the desired position and an ink droplet is ejected. The ink droplet size is changeable from dot to dot, by changing retraction voltage V1 in the first step.

Although time t3 required for the third step (that is, the contraction speed of the ink chamber 113) and the magnitude of ejection voltage V2 (that is, the amount of contraction of the ink chamber 113) are constant in the foregoing description, these parameters may be varied. In general the droplet size changes as well, depending on the magnitude of ejection voltage V2 in the third step. The droplet size is thus reduced with reductions in ejection voltage V2. Therefore, the variety of controls is increased by controlling the parameter (V2) together with retraction voltage V1. The range of droplet size may be thus increased as well.

A second embodiment is provided for adjusting the meniscus position at the start of the third step by changing time t2 required for the second step while maintaining retraction voltage V1 in the first step constant. The position of point C at which the third step is started (that is, droplet ejection is started) is fixed in synchronous with the ejection timing clock described above. It is therefore required to change the position of point A at which the first step is started so as to increase time t2 required for the second step. In the second embodiment, several types of waveform data with time t2 in various lengths depending on the droplet size are stored in the storage section 144 in FIG. 4 to be read out for use. The remainder of the configurations are similar to those of the first embodiment.

Figure 9A:
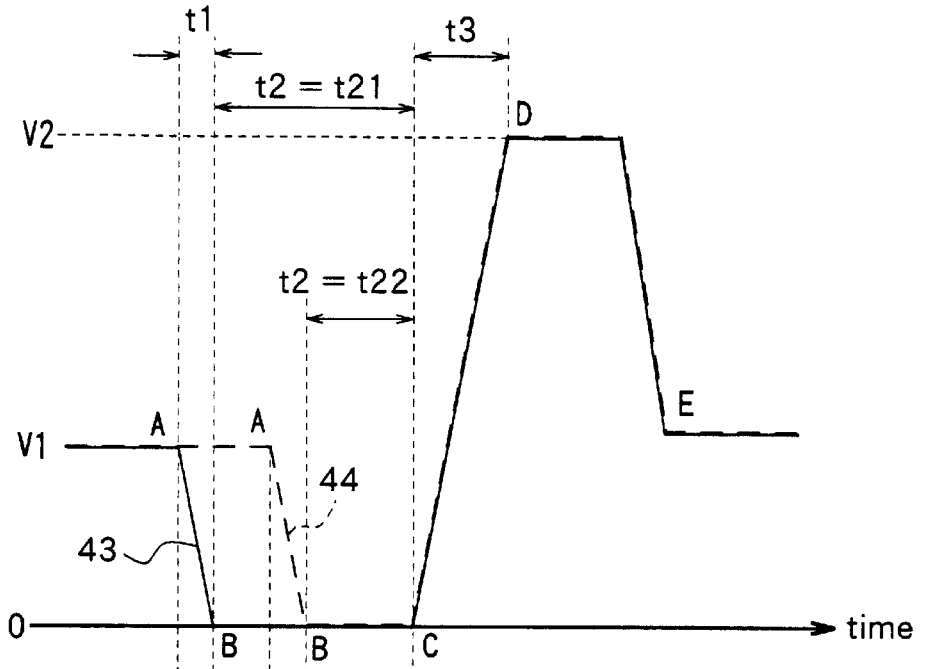
FIG. 9A and FIG. 9B show the shifts of meniscus when time required for the second step is varied.
Figure 9B:
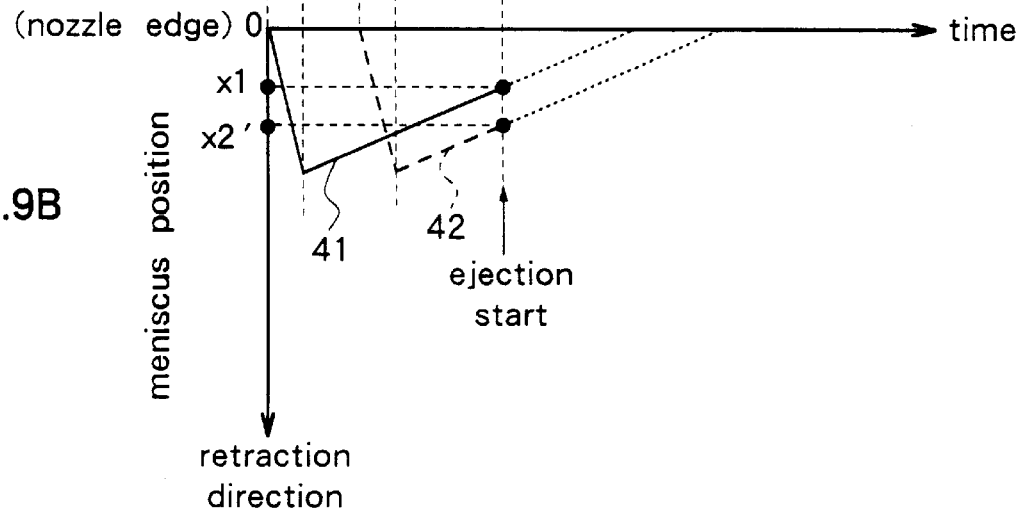

FIG. 9A and FIG. 9B show the shifts of meniscus position when time t2 required for the second step is varied while retraction voltage V1 in the first step is kept constant. FIG. 9A shows the voltage waveform of the head drive signal wherein the horizontal axis indicates time and the vertical axis indicates voltage. FIG. 9B shows the shifts of meniscus position wherein the horizontal axis indicates time and the vertical axis indicates the meniscus position (the distance between the nozzle edge and the meniscus). A locus 41 of the meniscus position in solid line corresponds to a voltage waveform 43 wherein the time required for the second step is longer (t2=t21). A locus 42 of the meniscus position in broken line corresponds to a voltage waveform 44 wherein the time required for the second step is shorter (t2=t22). In the embodiment, too, time t3 required for the third step and the magnitude of ejection voltage V2 are constant. Time t1 required for the first step is constant as well, which may be variable if necessary.

As shown, the time is short during which the meniscus retracted is allowed to advance towards the nozzle edge before ejection if time t2 required for the second step is short. Since the ink feed speed is constant, the advance speeds of meniscus (the gradients of the loci 41 and 42 of the meniscus moving towards the nozzle edge in FIG. 9B) are equal. Therefore, if the amount by which the meniscus is retracted is equal, the meniscus position at point C at which the third step is started (that is, ejection is started) is point x2' when t2 is shorter, which is deeper than point x1 when t2 is longer. The droplet size is thus reduced by reducing time t2 required for the second step. The droplet is changed to various sizes by changing t2 to various values.

Figures 10, 11:
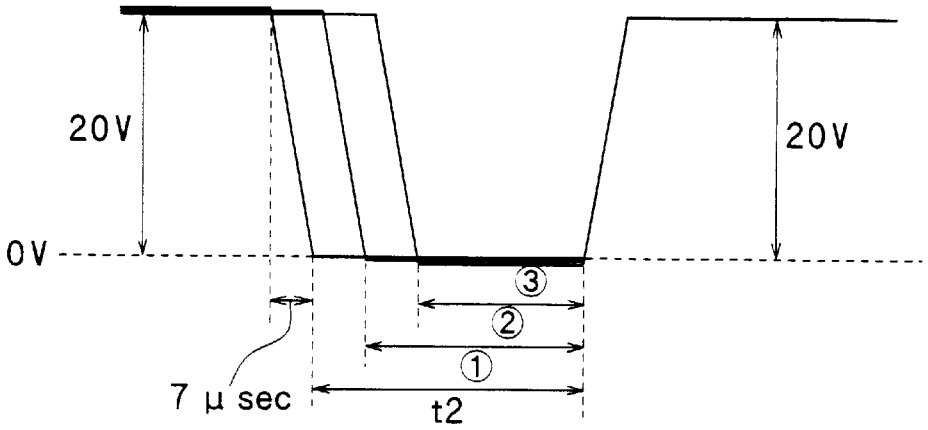
FIG. 10 illustrates drive voltage waveforms used in an experiment relating to the embodiment shown in FIG. 9A and FIG. 9B.
FIG. 11 shows the result obtained in the experiment.

FIG. 10 and FIG. 11 are provided for describing an example of experiment according to the embodiment. FIG. 10 illustrates drive voltage waveforms ① to ③ used in the experiment. FIG. 11 shows the meniscus positions at ejections and the diameters of droplets obtained, each corresponding to drive voltage waveforms ① to ③, respectively. In the example, retraction voltage V1 in the first step is fixed to 20 V, time t1 required for the first step to 7 $\mu$sec and ejection voltage V2 in the second step to 20 V. Time t2 required for the second step is set to three values ① 32 $\mu$sec, ② 16 $\mu$sec and ③ 4 $\mu$sec.

The meniscus positions at ejections with time t2 set to ① 32 $\mu$sec, ② 16 $\mu$sec and ③ 4 $\mu$sec are shown in FIG. 11. The droplet diameters thereby obtained are 40.0 $\mu$m, 34.4 $\mu$m and 22.4 $\mu$m, respectively. The droplet size is thus controllable as desired by changing time t2.

In the embodiment as described so far, the three steps are performed for ink ejection, including the first step in which the meniscus is retracted with retraction voltage V1; the second step in which ink is fed while the drive voltage is maintained at zero and the meniscus position is adjusted to a desired position; and the third step in which ejection voltage V2 is applied when the meniscus reaches the desired position and an ink droplet is ejected. The ink droplet size is changeable from dot to dot, by changing time t2 required for the second step.

As described above, the droplet size is changed with time t3 required for the third step (that is, the contraction speed of the ink chamber 113) and the magnitude of ejection voltage V2 (that is, the amount of contraction of the ink chamber 113) as well. Therefore, the variety of controls is increased by controlling the parameters (t3 and V2) together with time t2. The range of droplet size may be thus increased as well.

A third embodiment is provided for adjusting the meniscus position at the start of the third step by changing both amount of meniscus retraction in the first step and time t2 required for the second step. The position of point C at which the third step is started (that is, droplet ejection is started) is fixed in synchronous with the ejection timing clock described above. It is therefore required to change the position of point A at which the first step is started so as to change time t2 required for the second step. Therefore, in the third embodiment, the meniscus position is adjusted by changing the magnitude of retraction voltage V1 in the first step and point A at which the first step is started. In the embodiment, several types of waveform data each with a combination of different retraction voltage V1 and time t2 depending on the droplet size are stored in the storage section 144 in FIG. 4 to be read out for use. The remainder of the configurations are similar to those of the first embodiment.

Figure 12A:
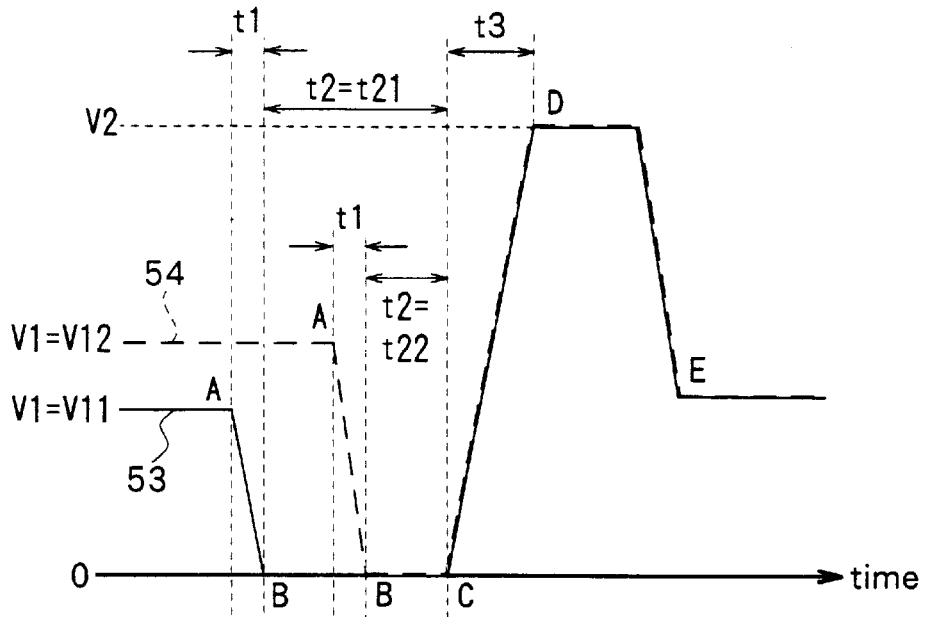
FIG. 12A and FIG. 12B show the shifts of meniscus when both meniscus retraction voltage in the first step and time required for the second step are varied.
Figure 12B:
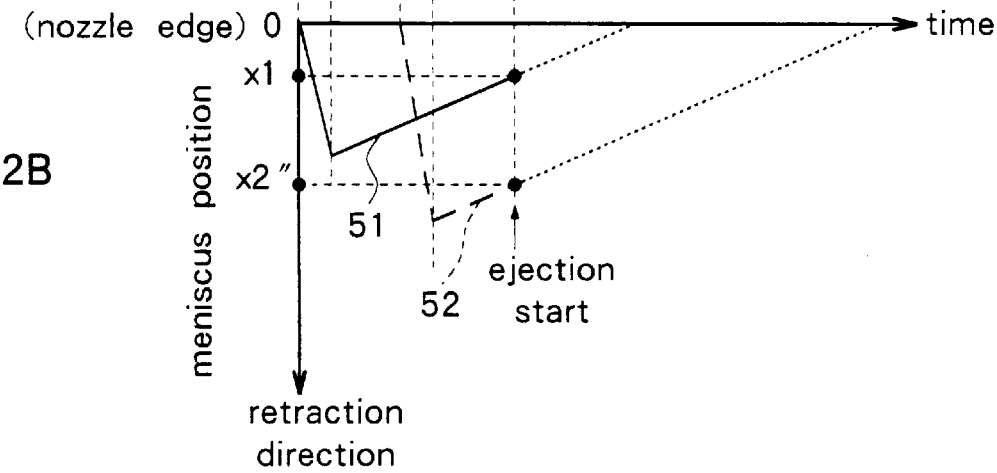

FIG. 12A and FIG. 12B show the shifts of meniscus position when both amount of meniscus retraction and time t2 required for the second step are varied. FIG. 12A shows the voltage waveform of the head drive signal wherein the horizontal axis indicates time and the vertical axis indicates voltage. FIG. 12B shows the shifts of meniscus position wherein the horizontal axis indicates time and the vertical axis indicates the meniscus position (the distance between the nozzle edge and the meniscus). A locus 51 of the meniscus position in solid line corresponds to a voltage waveform 53 wherein the retraction voltage in the first step is lower (V1=V11) and the time required for the second step is longer (t2=t21). A locus 52 of the meniscus position in broken line corresponds to a voltage waveform 54 wherein the retraction voltage in the first step is higher (V1=V12) and the time required for the second step is shorter (t2=t22). In the embodiment, too, time t3 required for the third step and the magnitude of ejection voltage V2 are constant. Time t1 required for the first step is constant as well, which may be variable if necessary.

As shown, the meniscus is retracted to the deeper position with the high retraction voltage. The time is short during which the meniscus retracted is allowed to advance towards the nozzle edge before ejection if time t2 required for the second step is short. Since the ink feed speed is constant, the advance speeds of meniscus (the gradients of the loci 51 and 52 of the meniscus moving towards the nozzle edge in FIG. 12B) are equal. Therefore, the meniscus position at point C at which the third step is started (that is, ejection is started) is point x2" when retraction voltage V1 is higher and time t2 is shorter, which is deeper than point x1 when retraction voltage V1 is lower and time t2 is longer. That is, ejection is performed when the meniscus position is deeper if the amount of retraction in the first step is raised and time t2 is reduced. The droplet size is thus reduced by increasing the amount of retraction in the first step and reducing time t2 required for the second step.

The droplet may be changed to various sizes with changing retraction voltage V1 and time t2 to various values. For example, both retraction voltage V1 and time t2 may be increased. In contrast, both retraction voltage V1 and time t2 may be reduced. The variety of controls is thereby achieved.

As described above, the droplet size is changed with time t3 required for the third step (that is, the contraction speed of the ink chamber 113) and the magnitude of ejection voltage V2 (that is, the amount of contraction of the ink chamber 113) as well. Therefore, the variety of controls is increased by controlling the parameters (t3 and V2) together with retraction voltage V1 and time t2. The range of droplet size is thus increased as well.

Figure 14:
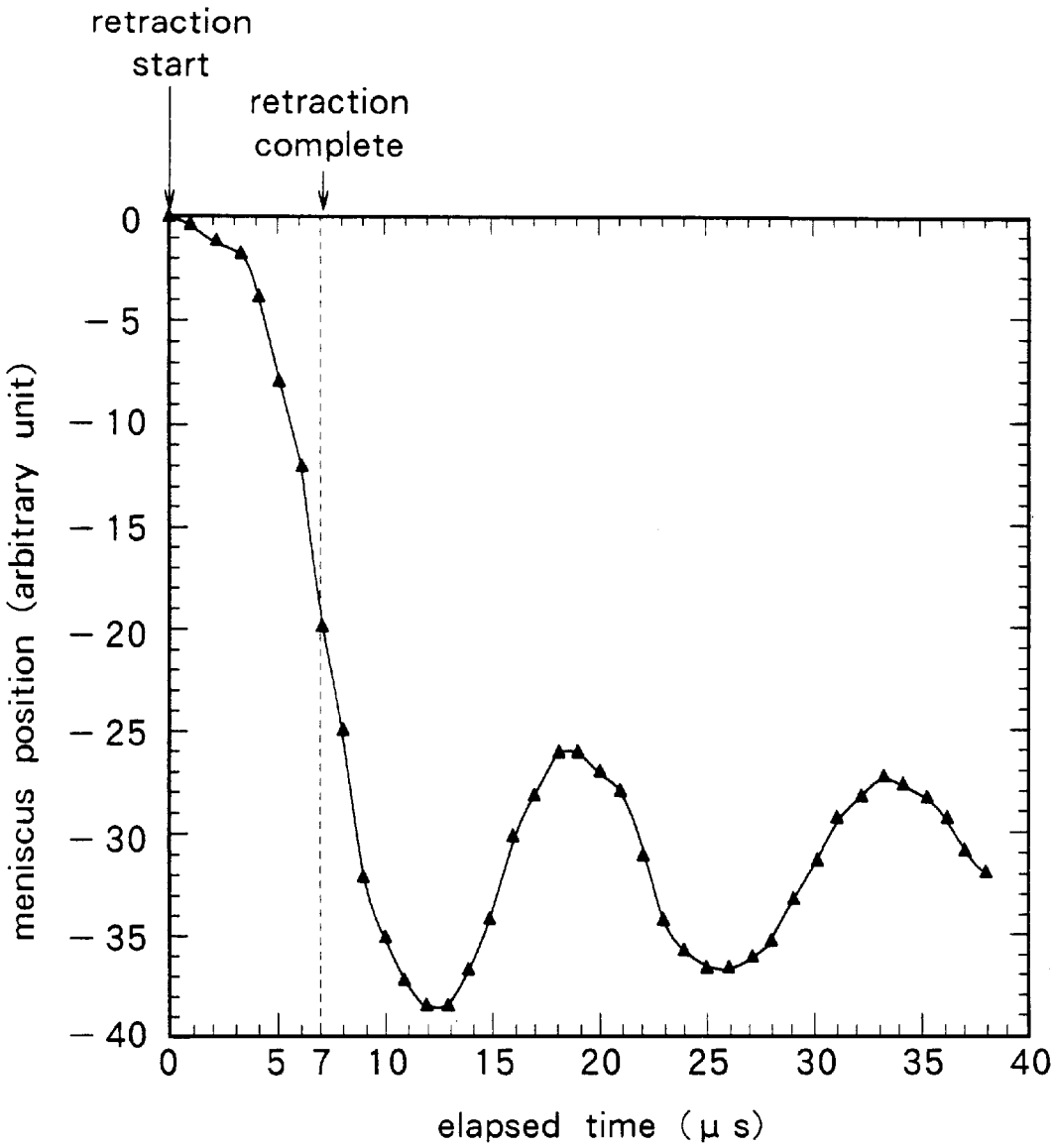
FIG. 14 shows the result of measurement on variations in meniscus position after retraction.

A fourth embodiment is provided for controlling the velocity of ink droplet ejected. When the first step is performed, as shown in FIG. 5B and FIG. 5C, the voltage applied to the piezoelectric element 122 is reduced to zero so that the bent in the oscillation plate 111*c* is eliminated and the ink chamber 113 is expanded as $P_B$ in FIG. 5B. Consequently, the meniscus in the nozzle 115 is retracted towards the ink chamber 113. At point B the meniscus is retracted as deep as $M_B$ in FIG. 5C, that is, moves away from the nozzle edge. However, the meniscus position thus retracted oscillates afterwards with a waveform as shown in FIG. 14 to be described below. This is because the bent in the oscillation plate 112*c* is not immediately reduced to zero and the oscillation plate 112*c* does not stands still after the voltage applied to the piezoelectric element 122 is reduced to zero. Instead, minute oscillations remain whose frequency depends on the properties of the piezoelectric element 122, the oscillation plate 111*c*, ink in the ink chamber 113 and so on.

FIG. 14 mentioned above shows the shifts of meniscus position after retraction in the first step. The measured values are shown wherein retraction voltage V1 is 20 V and time t1 required for the retraction (that is, the time required for the first step) is 7 $\mu$sec. The experiment is carried out wherein ink feed to the ink chamber 113 is stopped. The horizontal axis indicates time elapsed wherein the start point of the first step is zero in $\mu$sec. The vertical axis indicates the meniscus position (a displacement from the nozzle edge) in arbitrary units. As shown, the meniscus does not stop immediately at the point where the first step is completed but is gradually attenuated, oscillating in a constant cycle. The oscillation cycle is equal to that of the oscillation plate 112*c* described above. The oscillation cycle is of the specific value depending on the structure and material of the ink chamber 113 and the piezoelectric element 122, the properties of ink and so on. It is thus possible to define the cycle beforehand through experiments.

Figures 13A, 13B, 13C:
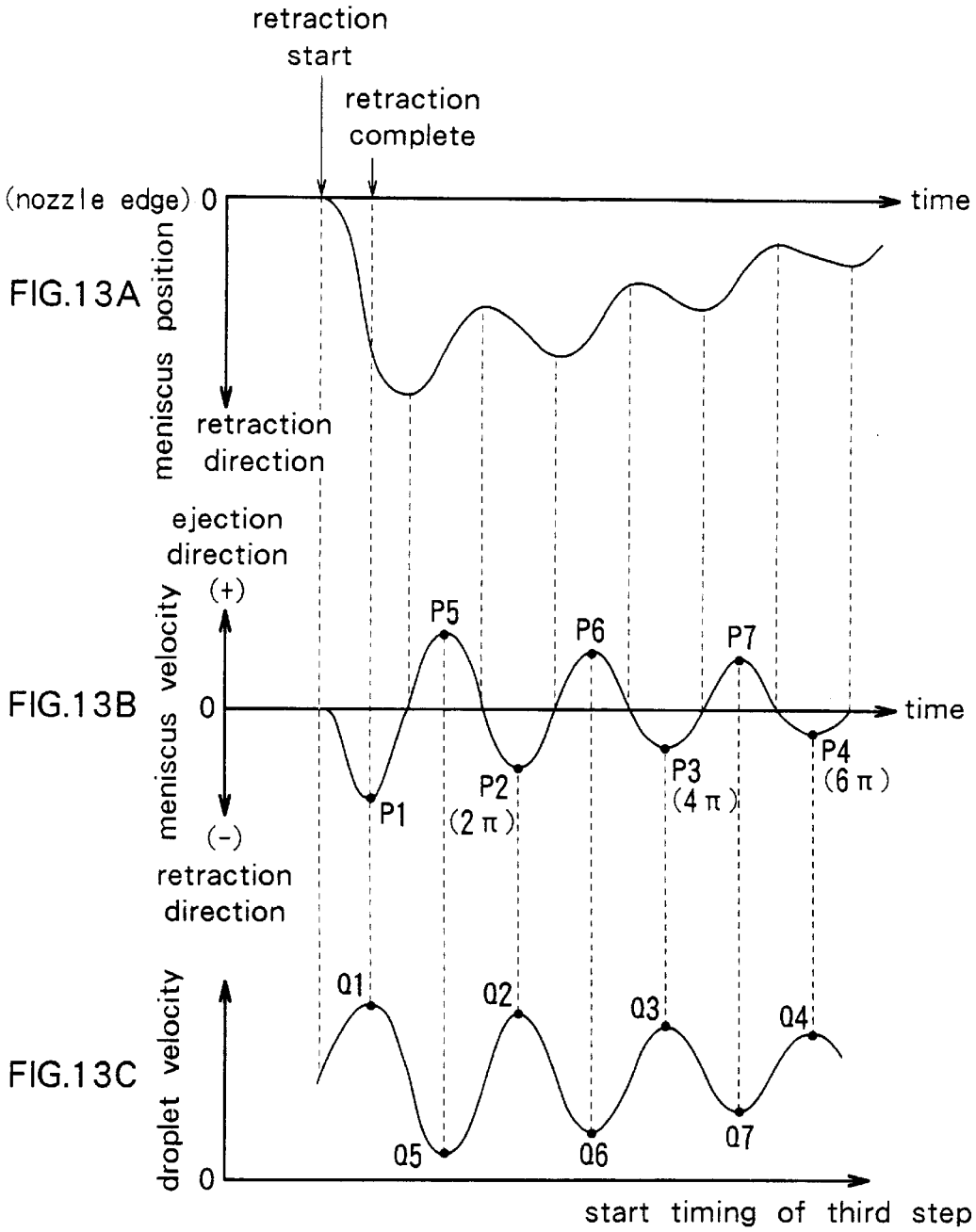
FIG. 13A shows the meniscus position displacement curve with ink feed.
FIG. 13B shows the meniscus position velocity curve obtained by differentiation of the meniscus position displacement curve in FIG. 13A.
FIG. 13C shows the variation of velocity of ejected droplet obtained when the third step is started at each point on the meniscus position velocity curve in FIG. 13B.

After the first step is performed, the second step is performed for maintaining the volume of the ink chamber 113 constant with the drive voltage fixed to zero during time t2 between points B and C in FIG. 5A. Since ink is continuously fed from the ink cartridge 12, the meniscus position in the nozzle 115 is gradually shifted towards the nozzle edge. At point C the meniscus position proceeds as far as the state of $M_C$ shown in FIG. 5C, for example. In addition, the meniscus shifts in the intrinsic (or proper or natural) oscillation cycle as shown in FIG. 14. Those two types of displacements overlap each other so that the meniscus position forms a locus as shown in FIG. 13A, for example, wherein the horizontal axis indicates time and the vertical axis indicates the meniscus position (a displacement from the nozzle edge). As shown, the meniscus position is abruptly shifted towards the ink chamber 113 at the start point of retraction in the first step and then gradually moves towards the nozzle edge while oscillating in a constant cycle.

Next, the third step is performed for abruptly increasing the drive voltage from voltage 0 at point C to ejection voltage V2 at point D. Point C synchronizes with the ejection timing pulse(not shown) mentioned above. Since high ejection voltage V2 is applied to the piezoelectric element 122 at point D, the oscillation plate 112*c* is greatly bent inward as $P_D$ in FIG. 5B. The ink chamber 113 is thereby abruptly contracted. Consequently, as $M_D$ in FIG. 5C, the meniscus in the nozzle 115 is pressed towards the nozzle edge at a stretch through which an ink droplet is ejected. The droplet ejected flies in the air and lands on the paper 2.

Next, the drive voltage is reduced to V1 again so that the oscillation plate 111*c* is slightly bent inward to be in the initial status ($P_E$ in FIG. 5B). This status is maintained until point F at which the first step of next ejection cycle is started. At point E immediately after the drive voltage is reduced to V1 again, as $M_E$ in FIG. 5C, the meniscus position is retreated by the amount nearly corresponding to the amount of ink ejected. With ink refilling, the meniscus position returns to the position of the nozzle edge, as $M_F$ in FIG. 5C, at point F at which the first step of next ejection cycle is started. This status is similar to $M_A$ at point A.

The cycle of ejection is thus completed. Such a cycle of operation is repeated for each of the nozzles 115 in a parallel manner. Image recording on the paper 2 is thereby continuously performed.

Figure 15:
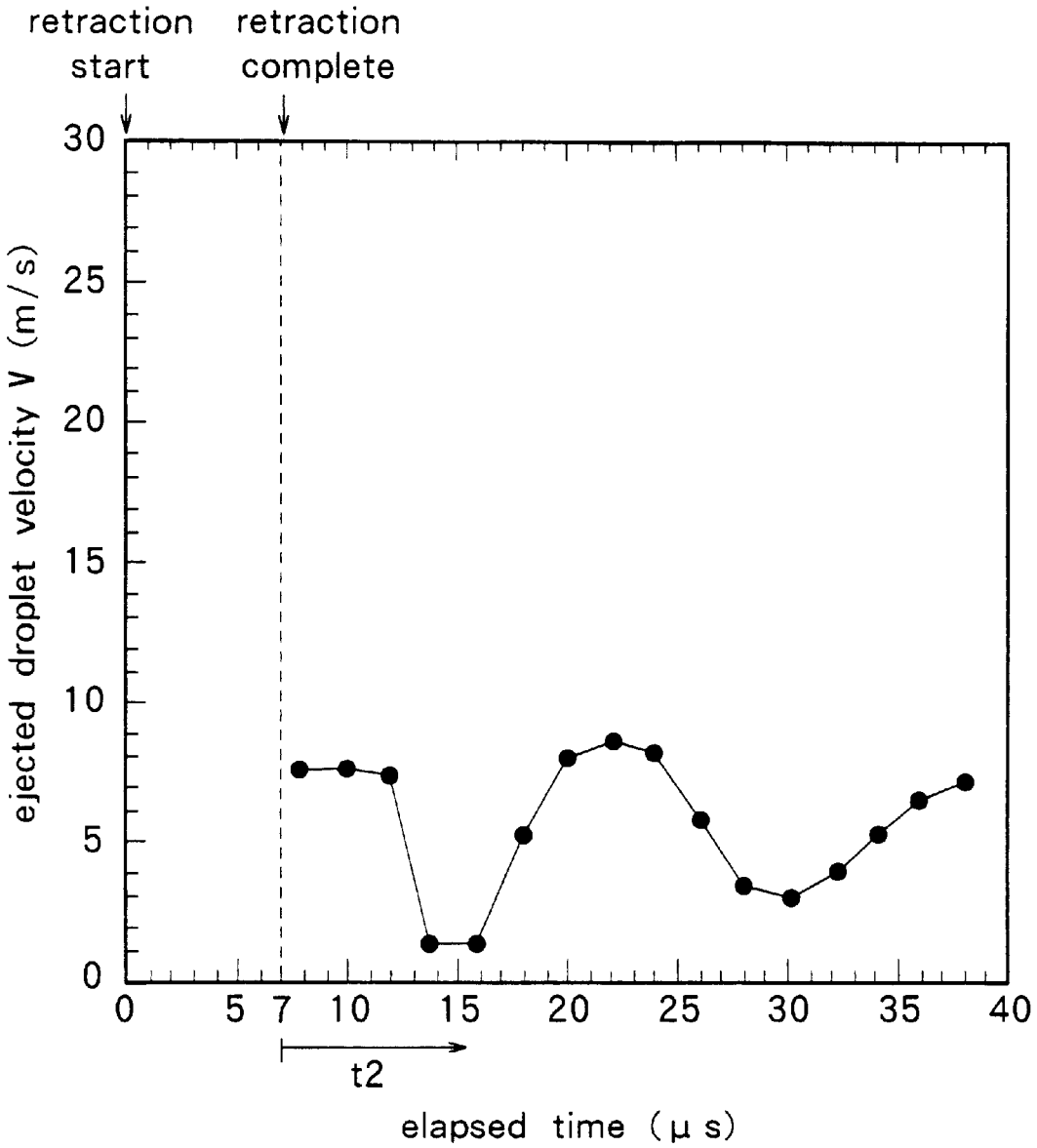
FIG. 15 shows the result of measurement on variations in velocity of ejected droplet with time between the start point of retraction and the start point of the third step.
Figure 16:
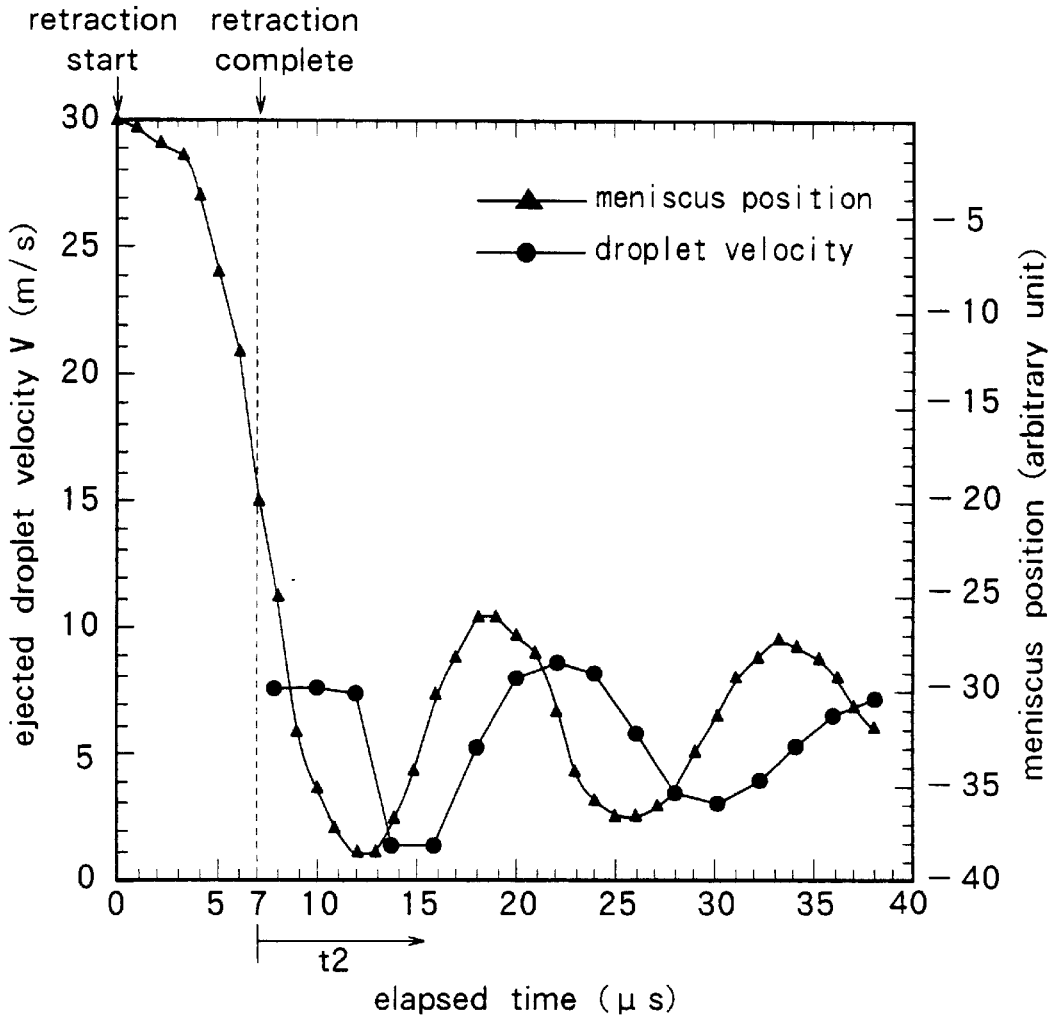
FIG. 16 shows the result shown in FIG. 14 overlaid on the result shown in FIG. 15.

Reference is now made to FIG. 14 to FIG. 16 showing the experiment results for describing the relationship between the natural oscillations of meniscus and the velocity of ejected droplet. As mentioned above, FIG. 14 shows the shifts of meniscus position after retraction in the first step without ink feed. FIG. 15 shows the velocity of ejected droplet with time t2 required for the second step (that is, time between the point of meniscus retraction and the start point of the third step for ejection) changed. The horizontal axis indicates time elapsed wherein the start point of the first step is zero in μsec. The vertical axis indicates the velocity of ejected droplet obtained wherein the third step is started at each elapsed time in meters per second (m/sec). FIG. 16 shows FIG. 14 overlaid on FIG. 15. The horizontal axis indicates time elapsed wherein the start point of the first step is zero. The vertical axis indicates the meniscus position and the velocity of ejected droplet obtained wherein the third step is started at each elapsed time. In FIG. 16 black deltas (▲) indicate the meniscus positions. Black circles (●) indicate the velocities of ejected droplets. As shown in FIG. 14 to FIG. 16, time t2 required for the second step is the time elapsed from the point at which meniscus retraction is completed (after a lapse of 7 μsec).

As shown in FIG. 16, the droplet velocity is of the peak value if the third step is started at the instant when the meniscus position is shifted in the direction of retraction at the highest speed (at the point wherein the gradient of meniscus position displacement curve is of the negative peak value). In contrast, the droplet velocity is the minimum if the third step is started at the instant when the meniscus position is shifted in the direction of ejection at the highest speed (at the point wherein the gradient of meniscus position displacement curve is of the positive peak value). That is, the variation cycle of the ejected droplet velocity is equal to the cycle of meniscus travel velocity and the phases thereof are shifted approximately 180 degrees (that is, a half cycle) from each other.

The concept of the fact described so far will now be described, referring to FIG. 13A to FIG. 13C. As described above, FIG. 13A shows the meniscus position displacement curve with ink feed. FIG. 13B shows the meniscus travel velocity curve obtained by differentiation of the meniscus position displacement curve in FIG. 13A. The horizontal axis indicates time and the vertical axis indicates the meniscus travel velocity (referred to as the meniscus velocity in the following description). The velocity in the direction of ejection of droplet is indicated as (+) and the direction of meniscus retraction as (−). FIG. 13C shows velocity of ejected droplet obtained when the third step is started at each point on the meniscus velocity curve in FIG. 13B. The horizontal axis indicates timing of the start of the third step and the vertical axis indicates the ejected droplet velocity. Both horizontal and vertical axes indicate the values in arbitrary units.

As shown in FIG. 13B, the meniscus velocity changes in an intrinsic oscillation cycle and the amplitude of change gradually attenuates. Corresponding to the meniscus velocity, as shown in FIG. 13C, the ejected droplet velocity changes in the same oscillation cycle as the meniscus velocity and the amplitude of change gradually attenuates. As described with reference to FIG. 16, the phase of change of ejected droplet velocity is shifted from the phase of change of meniscus velocity by nearly half a cycle. Therefore, the ejected droplet velocity is higher if ejection is performed when the meniscus position is shifted in the direction of retraction, compared to if ejection is performed when the meniscus position is shifted in the direction of ejection. Furthermore, the ejected droplet velocity increases with an increase in the meniscus velocity in the direction of retraction. For example, if the third step is started at a point when the meniscus velocity is of the peak value in the direction of retraction (point P1, P2, P3 or P4, for example), the ejected droplet velocity is of the peak value (point Q1, Q2, Q3 or Q4, for example). In contrast, if the third step is started at a point when the meniscus velocity is of the peak value in the direction of ejection (point P5, P6 or P7, for example), the ejected droplet velocity is of the minimum value (point Q5, Q6 or Q7, for example).

As thus described, the ejected droplet velocity directly relates to the meniscus velocity at the start point of the third step. As a result, the ejected droplet velocity is precisely controlled by appropriately determining or selecting the meniscus velocity at the start point of the third step. In particular, control is performed such that the ejected droplet velocity increases and maintains the maximum constant value if the first step is started such that the start point of the third step corresponds to the point when the meniscus velocity is of the peak value in the direction of retraction.

As described above, the ejected droplet velocity changes depending on the meniscus velocity at the start point of the third step. The amplitude of meniscus velocity changes depending on the amount of retraction in the first step. Therefore, if time between the point when retraction in the first step is completed and the start point of the third step is constant, the meniscus velocity at the start point of the third step is selected as desired by changing the amount of retraction in the first step. The ejected droplet velocity is thereby controlled. This fact will be further described, referring to FIG. 17A to FIG. 17C.

Figure 17A:
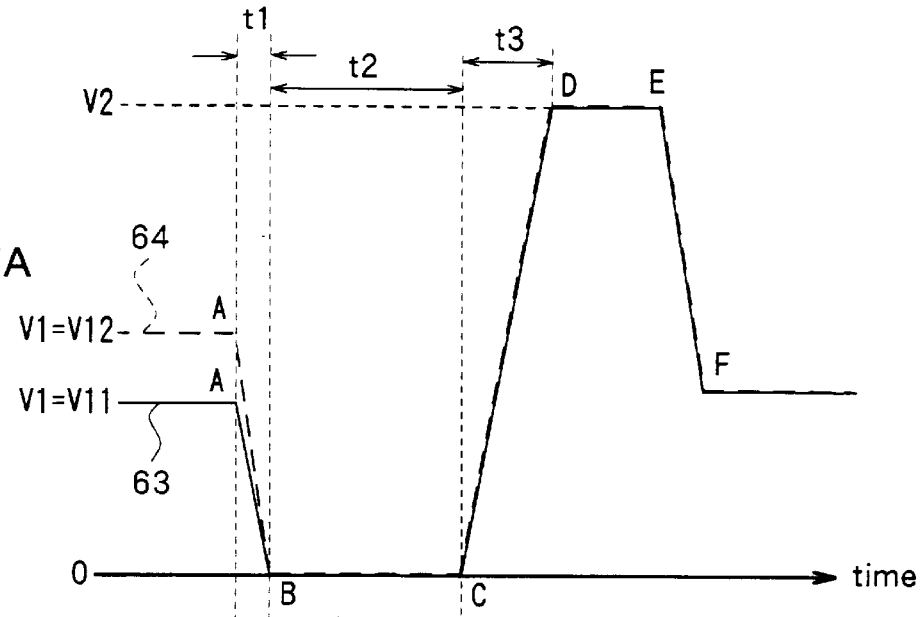
FIG. 17A to FIG. 17C illustrate a drive method of a recording head for an ink-jet printer of a fourth embodiment of the invention and particularly show the shifts of meniscus position and meniscus velocity when the retraction voltage in the first step is only varied.
Figure 17B:
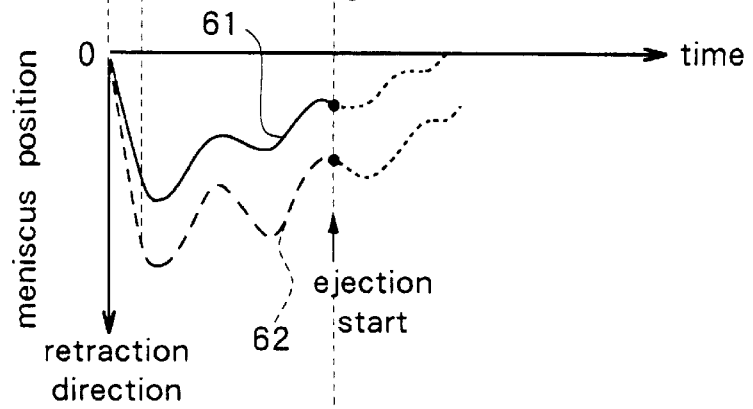
Figure 17C:
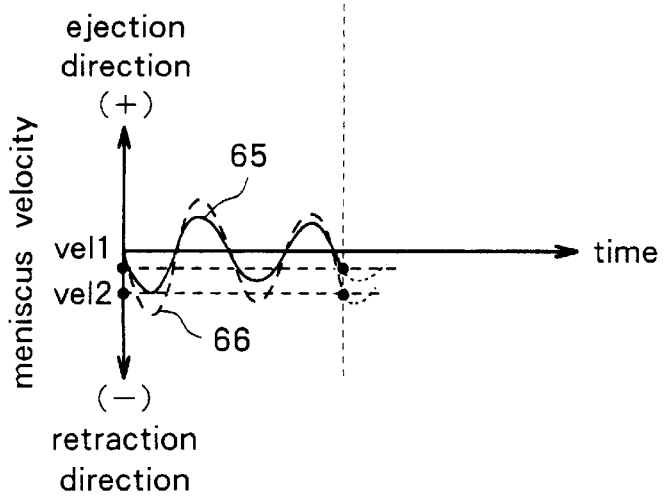

FIG. 17A to FIG. 17C show the shifts of meniscus position and meniscus velocity when retraction voltage V1 in the first step is varied while time t2 required for the second step is kept constant. FIG. 17A shows the voltage waveform of the head drive signal wherein the horizontal axis indicates time and the vertical axis indicates voltage. FIG. 17B shows the shifts of meniscus position wherein the horizontal axis indicates time and the vertical axis indicates the meniscus position (the distance between the nozzle edge and the meniscus). FIG. 17C shows the changes of meniscus velocity wherein the horizontal axis indicates time and the vertical axis indicates the meniscus velocity. A locus 61 of the meniscus position in solid line and a curve 65 indicating changes of meniscus velocity correspond to a voltage waveform 63 wherein the retraction voltage is lower (V1=V11). A locus 62 of the meniscus position in broken line and a curve 66 indicating changes of meniscus velocity correspond to a voltage waveform 64 wherein the retraction voltage is higher (V1=V12). In this description time t3 required for the third step and ejection voltage V2 are constant as described above. Time t1 required for the first step is constant, which may be variable if necessary.

As shown, the meniscus is deeply retracted with a higher retraction voltage. Since the ink feed speed is constant, the mean advance speed of meniscus (the mean value of gradients of the loci 61 and 62 of the meniscus moving towards the nozzle edge while oscillating in FIG. 17B) is constant. However, the amplitude of the locus 62 when retraction voltage V1 is higher is greater than that of the locus 61 when retraction voltage V1 is lower. The cycle of shifts of meniscus position is constant (FIG. 17B). Therefore, the maximum gradient of the locus 62 is greater than that of the locus 61. Consequently, the amplitude of the curve 66 is greater than that of the curve 65 as shown in FIG. 17C. Accordingly, if time t2 required for the second step (that is, time between point B at which retraction is completed and point C at which the third step is started) is constant, the meniscus velocity at point C at which the third step is started varies. In the example shown in FIG. 17A to FIG. 17C, velocity vel2 is obtained which is greater in the direction of retraction when retraction voltage V1 is higher. Velocity vel1 is obtained which is smaller in the direction of retraction when retraction voltage V1 is lower. That is, the meniscus velocity at point C at which the third step is started is changed by changing the magnitude of retraction voltage V1. The velocity of ejected droplet is thereby controlled.

Figure 18:
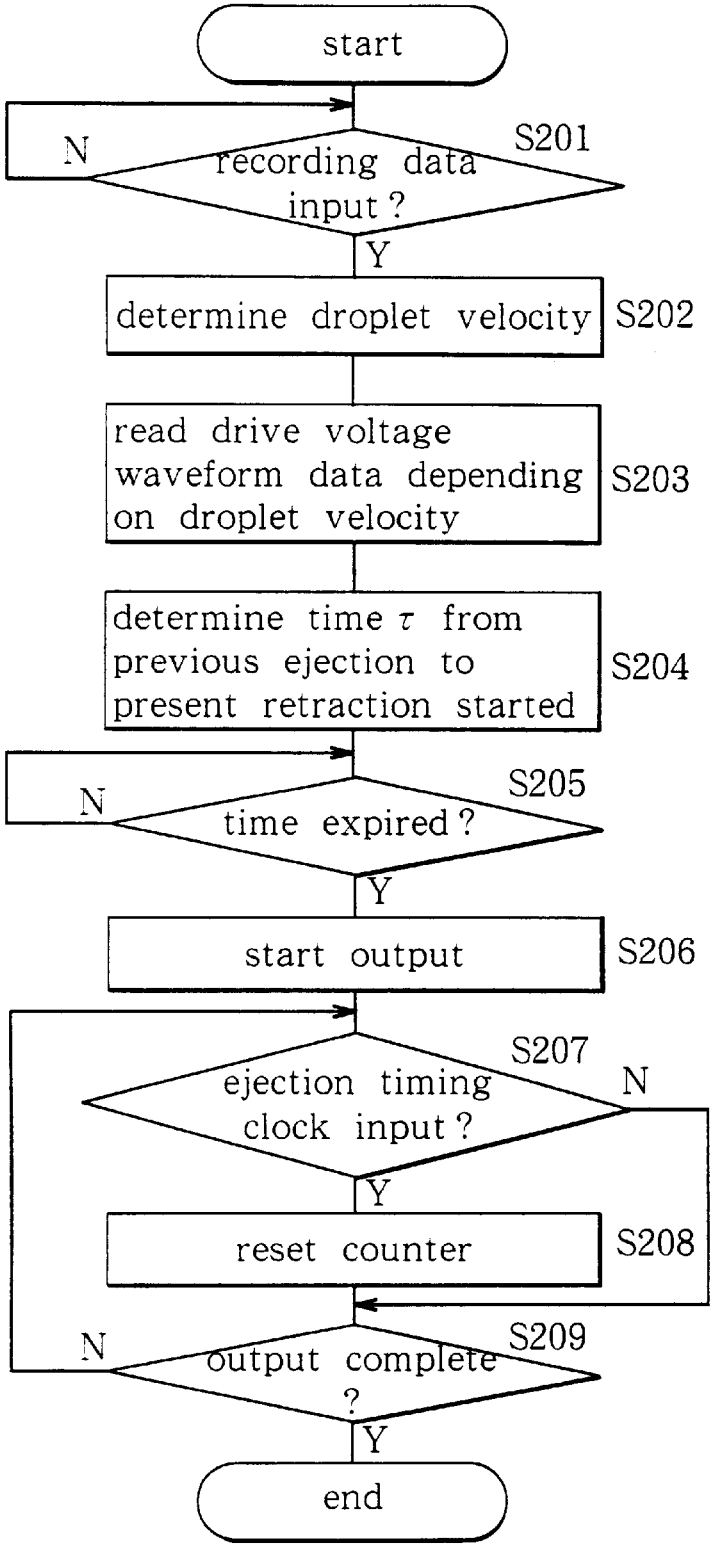
FIG. 18 is a flowchart for illustrating the operation of main control unit of the head controller.

The operation of the ink-jet printer 1 as a whole of the embodiment will now be described. FIG. 18 shows the main operation of one ejection cycle in the head controller 14 in FIG. 1. In this description the counter 145 (FIG. 4) in the head controller 14 is already reset in the immediately preceding ejection cycle. Voltage V1 at point I (FIG. 5) at which ejection is completed in the immediately preceding cycle is maintained until a head drive signal is outputted in step S206 in FIG. 18.

In FIG. 1 printing data is inputted to the ink-jet printer 1 from an information processing apparatus such as a personal computer. The image processor 15 performs specific image processing on the input data (such as expansion of compressed data) and outputs the data as recording data to the head controller 14.

On receipt of the recording data (Y in step S201 in FIG. 18), the main control section 141 (FIG. 4) in the head controller 14 determines (selects) a velocity of ink droplet to be ejected for forming a specific dot based on the data (step S202).

For example, if the travel velocity of the recording head 11 slightly changes depending on the position on a stroke, the droplet velocity is determined in accordance with the coordinate of each dot along the stroke so as to compensate the error in recording head velocity. For example, if the carriage travel velocity of the recording head 11 is lower at both ends compared to the center, it is determined that the droplet velocity is lower at both ends and higher in the center.

If it is ensured that the travel velocity of the recording head 11 is precisely constant regardless of the position on a stroke, the droplet velocity is determined to be constant. In these cases, the absolute value of droplet velocity is predetermined, taking the distance between the recording head 11 and paper and other conditions into consideration.

Next, the main control section 141 reads drive voltage waveform data corresponding to the selected droplet velocity from the storage section 144 (step S203). As described with reference to FIG. 4, waveform data in various forms corresponding to droplet velocities is stored in the storage section 144. In the embodiment, waveform data having retraction voltage V1 corresponding to the selected droplet velocity is read for each dot when the droplet velocity is changed depending on the position of the recording head 11 as mentioned above. In order to control the droplet velocity to be constant, one type of predetermined waveform data is only read repeatedly for every dot.

Next, the main control section 141 determines time $\tau$ between point H at which the third step in the previous cycle is started (that is, the point of ejection at which the counter 145 is reset and counting is started) and point A at which retraction in the present cycle is started (the start point of the first step) based on the read waveform data (step S204). As shown in FIG. 5A, time $\tau$ is given by subtracting the sum of time required for the first and second steps (t1+t2) from interval T between ejections (the cycle of ejection timing clock). The operations in steps S201 to S204 described so far are performed in a short time between point I and point A in FIG. 5A. If voltage V1 in the waveform data read in the present cycle (that is, the voltage at point A) is different from the voltage at point I in the previous ejection cycle, the value of voltage V1 applied to the piezoelectric element 122 is changed to the value read in the present cycle and the value is maintained.

Next, the main control section 141 waits until time $\tau$ expires (step S205). Time $\tau$ having expired, an expiration signal is inputted from the counter 145 (Y in step S205). The main control section 141 then starts outputting the read waveform data (step S206). The waveform data is converted to an analog signal at the D-A converter 146 and amplified at the amplifier 147 to be supplied to the recording head 11 as a head drive signal with a waveform as A to E in FIG. 5A, for example. In the recording head 11, the three steps described with reference to FIG. 5A to FIG. 5C are performed based on the voltage waveform of the head drive signal. An ink droplet with the velocity as determined by the waveform data is thus ejected. In the period after point E, preparation for next ejection cycle is performed, that is, the droplet velocity is determined and the waveform data is read and so on (steps S201 to S204). Such ejection and preparation for ejection are repeated.

After the head drive signal is started to be outputted in step S206, an ejection timing clock is inputted at point C at which the third step is started (Y in step S207). The counter 145 is reset and start counting for next ejection cycle (step S208). The third step is completed at point D in FIG. 5A (step S209). Voltage V1 is maintained or changed as described above and maintained after the drive voltage is returned to V1 at point E until point F at which next ejection cycle is started. During this period the ink chamber 113 is refilled with ink to prepare for next ejection. The one ejection cycle is thus completed.

In the embodiment as described so far, the three steps are performed for ink ejection, including the first step in which the meniscus is retracted with retraction voltage V1; the second step in which ink is fed while the drive voltage is maintained at zero and the meniscus position is moved forward; and the third step in which ejection voltage V2 is applied in accordance with the meniscus velocity shifting in an intrinsic oscillation cycle and an ink droplet is ejected. The meniscus velocity at the start of ejection is determined as desired by changing retraction voltage V1 in the first step. The velocity of ejected droplet is thereby changed as desired. It is possible to precisely maintain the droplet velocity constant by fixing retraction voltage V1.

Although time t3 required for the third step (that is, the contraction speed of the ink chamber 113) and the magnitude of ejection voltage V2 (that is, the amount of contraction of the ink chamber 113) are constant in the foregoing description, these parameters may be varied. In general the droplet velocity changes as well, depending on time t3. The droplet velocity is thus increased with a reduction in time t3. Therefore, the variety of controls is increased by controlling the parameter (t3) together with retraction voltage V1. The range of droplet velocity may be thus increased as well.

A fifth embodiment is provided for adjusting the meniscus velocity at the start of the third step by changing time t2 required for the second step while maintaining retraction voltage V1 in the first step constant. The position of point C at which the third step is started (that is, droplet ejection is started) is fixed in synchronous with the ejection timing clock described above. It is therefore required to change the position of point A at which the first step is started so as to increase time t2 required for the second step. In the fifth embodiment, several types of waveform data with time t2 in various lengths depending on the droplet velocity are stored in the storage section 144 in FIG. 4 to be read out for use. The remainder of the configurations are similar to those of the foregoing fourth embodiment.

Figures 19A, 19B, 19C:
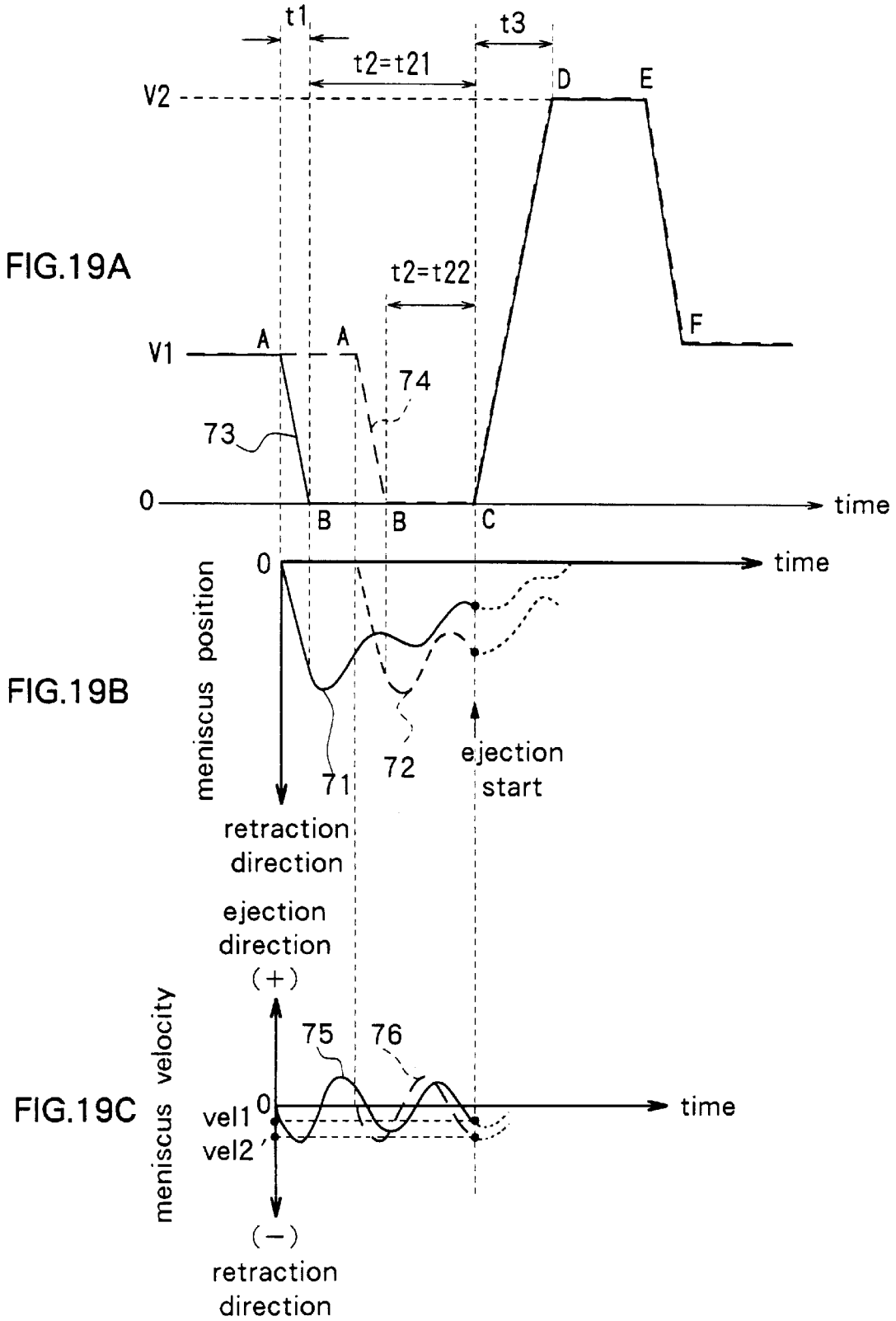
FIG. 19A to FIG. 19C illustrate a drive method of a recording head for an ink-jet printer of a fifth embodiment of the invention and particularly show the shifts of meniscus position and meniscus velocity when time required for the second step is only varied.

FIG. 19A to FIG. 19C show the shifts of meniscus position and meniscus velocity when time t2 required for the second step is varied while retraction voltage V1 in the first step is kept constant. FIG. 19A shows the voltage waveform of the head drive signal wherein the horizontal axis indicates time and the vertical axis indicates voltage. FIG. 19B shows the shifts of meniscus position wherein the horizontal axis indicates time and the vertical axis indicates the meniscus position (the distance between the nozzle edge and the meniscus). FIG. 17C shows the changes of meniscus velocity wherein the horizontal axis indicates time and the vertical axis indicates the meniscus velocity. A locus 71 of the meniscus position in solid line corresponds to a voltage waveform 73 wherein the time required for the second step is longer (t2=t21). A locus 72 of the meniscus position in broken line corresponds to a voltage waveform 74 wherein the time required for the second step is shorter (t2=t22). In the embodiment, too, time t1 required for the first step, time t3 required for the third step and the magnitude of ejection voltage V2 are constant.

As shown, with different time t2, the waveforms of the loci 71 and 72 are equal to each other (FIG. 18B). Consequently, the waveforms of meniscus velocity curves 75 and 76 are equal to each other as well. However, there is a shift difference between the loci 71 and 72 which corresponds to (t21–t22). Accordingly, there is a similar shift difference between the loci 75 and 76 as well. As a result, the meniscus velocities at point C at which the third step is started are different, retraction voltage V1 (that is, the amount of meniscus retraction) being equal, as shown in FIG. 18C.

In the example shown in FIG. 19A to FIG. 19C, velocity vel2' is obtained which is greater in the direction of retraction when time t2 is shorter. Velocity vel1 is obtained which is smaller in the direction of retraction when time t2 is longer. Therefore, the former allows a higher velocity of ejected droplet. However, depending on the length of time t2, the higher meniscus velocity and lower meniscus velocity at the point at which the third step is started may be reversed due to the phase difference between the curves 75 and 76. The higher and lower droplet velocities may be thus reversed. In any case the meniscus velocity at point C at which the third step is started is changed by changing time t2. The velocity of ejected droplet is thereby controlled.

In the embodiment as described so far, the three steps are performed for ink ejection, including the first step in which the meniscus is retracted with retraction voltage V1; the second step in which ink is fed while the drive voltage is maintained at zero and the meniscus position is moved forward; and the third step in which ejection voltage V2 is applied in accordance with the meniscus velocity shifting in an intrinsic oscillation cycle and an ink droplet is ejected. The meniscus velocity at the start of ejection is determined as desired by changing time t2 required for the second step. The velocity of ejected droplet is thereby controlled as desired. It is possible to precisely maintain the droplet velocity constant by fixing time t2.

As described above, the droplet velocity may change depending on time t3 required for the third step (that is, the contraction speed of the ink chamber 113) and the magnitude of ejection voltage V2 (that is, the amount of contraction of the ink chamber 113). Therefore, the variety of controls is increased by controlling the parameters (t3 and V2) together with time t2. The range of droplet velocity may be thus increased as well.

A sixth embodiment is provided for adjusting the meniscus velocity at the start of the third step by changing both amount of meniscus retraction in the first step and time t2 required for the second step. The position of point C at which the third step is started (that is, droplet ejection is started) is fixed in synchronous with the ejection timing clock described above. It is therefore required to change the position of point A at which the first step is started so as to change time t2 required for the second step. Therefore, in the sixth embodiment, the meniscus velocity is adjusted by changing the magnitude of retraction voltage V1 in the first step and point A at which the first step is started. In the embodiment, several types of waveform data each with a combination of different retraction voltage V1 and time t2 depending on the velocity of ejected droplet are stored in the storage section 144 in FIG. 4 to be read out for use. The remainder of the configurations are similar to those of the fourth or fifth embodiment.

Figure 20A:
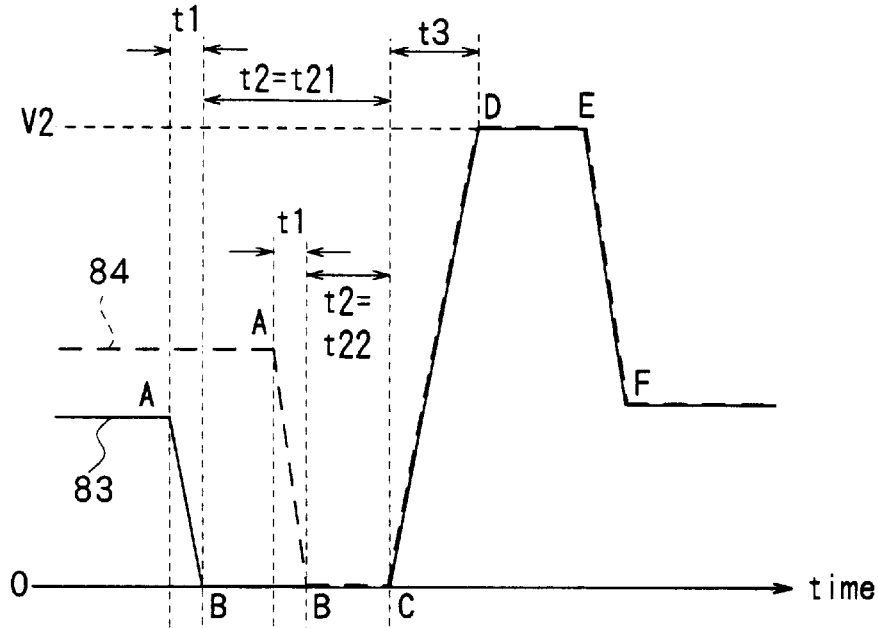
FIG. 20A to FIG. 20C illustrate a drive method of a recording head for an ink-jet printer of a sixth embodiment of the invention and particularly show the shifts of meniscus position and meniscus velocity when both meniscus retraction voltage and time required for the second step are varied.
Figure 20B:
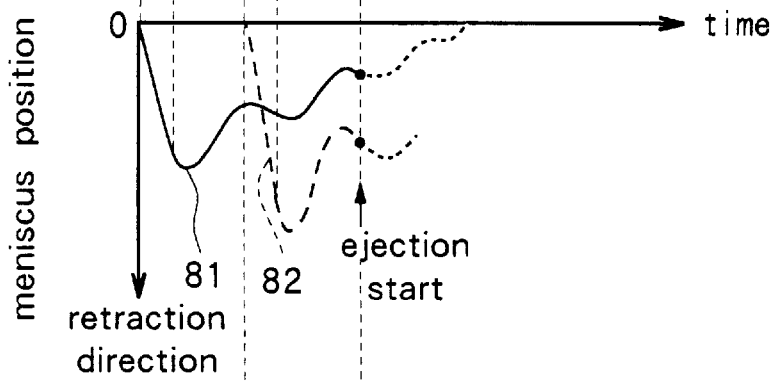
Figure 20C:
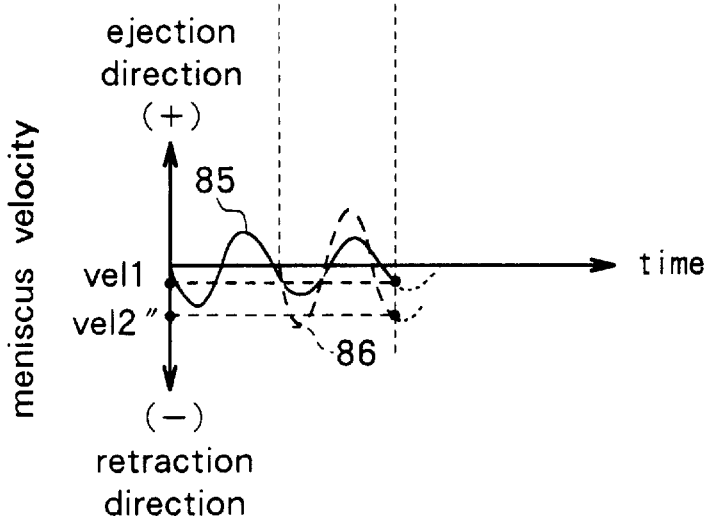

FIG. 20A to FIG. 20C show the shifts of meniscus position and meniscus velocity when both amount of meniscus retraction and time t2 required for the second step are varied. FIG. 20A shows the voltage waveform of the head drive signal wherein the horizontal axis indicates time and the vertical axis indicates voltage. FIG. 20B shows the shifts of meniscus position wherein the horizontal axis indicates time and the vertical axis indicates the meniscus position (the distance between the nozzle edge and the meniscus). FIG. 17C shows the changes of meniscus velocity wherein the horizontal axis indicates time and the vertical axis indicates the meniscus velocity. A locus 81 of the meniscus position in solid line corresponds to a voltage waveform 83 wherein the retraction voltage in the first step is lower (V1=V11) and the time required for the second step is longer (t2=t21). A locus 82 of the meniscus position in broken line corresponds to a voltage waveform 84 wherein the retraction voltage in the first step is higher (V1=V12) and the time required for the second step is shorter (t2=t22). In the embodiment, too, time t1 required for the first step, time t3 required for the third step and the magnitude of ejection voltage V2 are constant.

As shown, both retraction voltages V1 and lengths of time t2 are different in the example. Therefore, the loci 81 and 82 in FIG. 20B have the amplitudes and phases different from each other. Consequently, meniscus velocity curves 85 and 86 in FIG. 20C have the amplitudes and phases different from each other as well. The meniscus velocities at point C at which the third step is started are thus different.

In the example shown in FIG. 20A to FIG. 20C, velocity vel2" is obtained which is greater in the direction of retraction when retraction voltage V1 is higher and time t2 is shorter. Velocity vel1 is obtained which is smaller in the direction of retraction when retraction voltage V1 is lower and time t2 is longer. Therefore, the former allows a higher velocity of ejected droplet. However, depending on the length of time t2, the higher and lower meniscus velocities at the point at which the third step is started may be reversed due to the phase difference between the curves 85 and 86. The higher and lower droplet velocities may be thus reversed. In any case the meniscus velocity at point C at which the third step is started is changed by changing retraction voltage V1 and time t2. The velocity of ejected droplet is thereby controlled.

In the embodiment as described so far, the three steps are performed for ink ejection, including the first step in which the meniscus is retracted with retraction voltage V1; the second step in which ink is fed while the drive voltage is maintained at zero and the meniscus position is moved forward; and the third step in which ejection voltage V2 is applied in accordance with the meniscus velocity shifting in an intrinsic oscillation cycle and an ink droplet is ejected. The meniscus velocity at the start of ejection is determined as desired by changing retraction velocity V1 in the first step and time t2 required for the second step. The velocity of ejected droplet is thereby controlled as desired. It is possible to precisely maintain the droplet velocity constant by fixing retraction voltage V1 and time t2.

The droplet velocity may be changed to various values with changing retraction voltage V1 and time t2 to various values. For example, both retraction voltage V1 and time t2 may be increased. On the contrary, both retraction voltage V1 and time t2 may be reduced. The variety of controls is thereby achieved.

As described above, the droplet velocity may change depending on time t3 required for the third step (that is, the contraction speed of the ink chamber 113) and the magnitude of ejection voltage V2 (that is, the amount of contraction of the ink chamber 113). Therefore, the variety of controls is increased by controlling the parameters (t3 and V2) together with time t2. The range of droplet velocity may be thus increased as well.

As shown in FIG. 13B, the meniscus velocity at the start point of the third step may be determined or selected by selecting a phase of meniscus velocity counted from the point of completion of retraction, for example. Since the variation cycle of ejected droplet velocity is equal to that of the meniscus velocity, the meniscus velocity is determined by the phase. The ejected droplet velocity is thereby determined. In practice, however, the amplitude of meniscus velocity variation gradually attenuates as shown in FIG. 13B. Therefore, the meniscus velocity is not precisely determined if the absolute phases is different (that is, there is a difference of integral multiple of the cycle) although the relative phase is identical. However, if ejection is performed at an early point immediately after retraction wherein the amount of attenuation is small yet (at a point before a couple of cycles), determining the relative phase and determining the meniscus velocity are nearly equal to each other. Accordingly, if the third step is started at the point when the relative phase of meniscus velocity reaches a specific value in the range of couple of cycles immediately after retraction, the ejected droplet velocity is nearly constant even if the ejection point is changed by the phase equal to an integral multiple of one cycle (2 $\pi$). For example, if ejection is started at each of points P1 to P4 wherein the absolute phase started from the completion point of retraction is 2n $\pi$ where n is an integer, the ejected droplet velocities obtained with such timing (the velocities obtained at points Q1 to Q4 in FIG. 13C) are nearly equal to one another. The droplet velocities close to maximums are obtained particularly in this example.

In contrast, the ejected droplet velocity is precisely kept constant if the absolute phase of the start point of the third step is fixed to one (2 $\pi$, for example).

Figure 21:
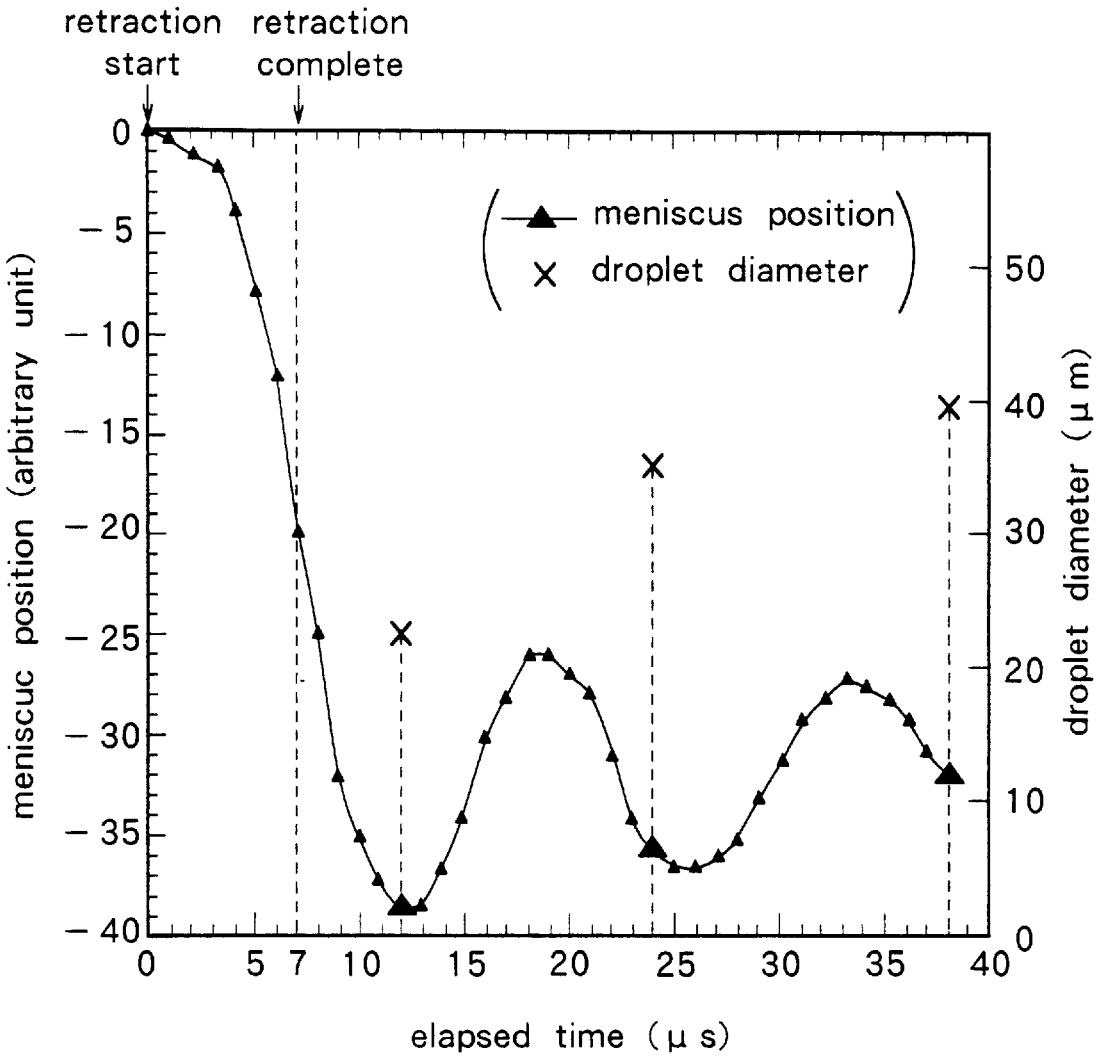
FIG. 21 shows the result of measurement on variations in meniscus position after retraction.
Figure 22:
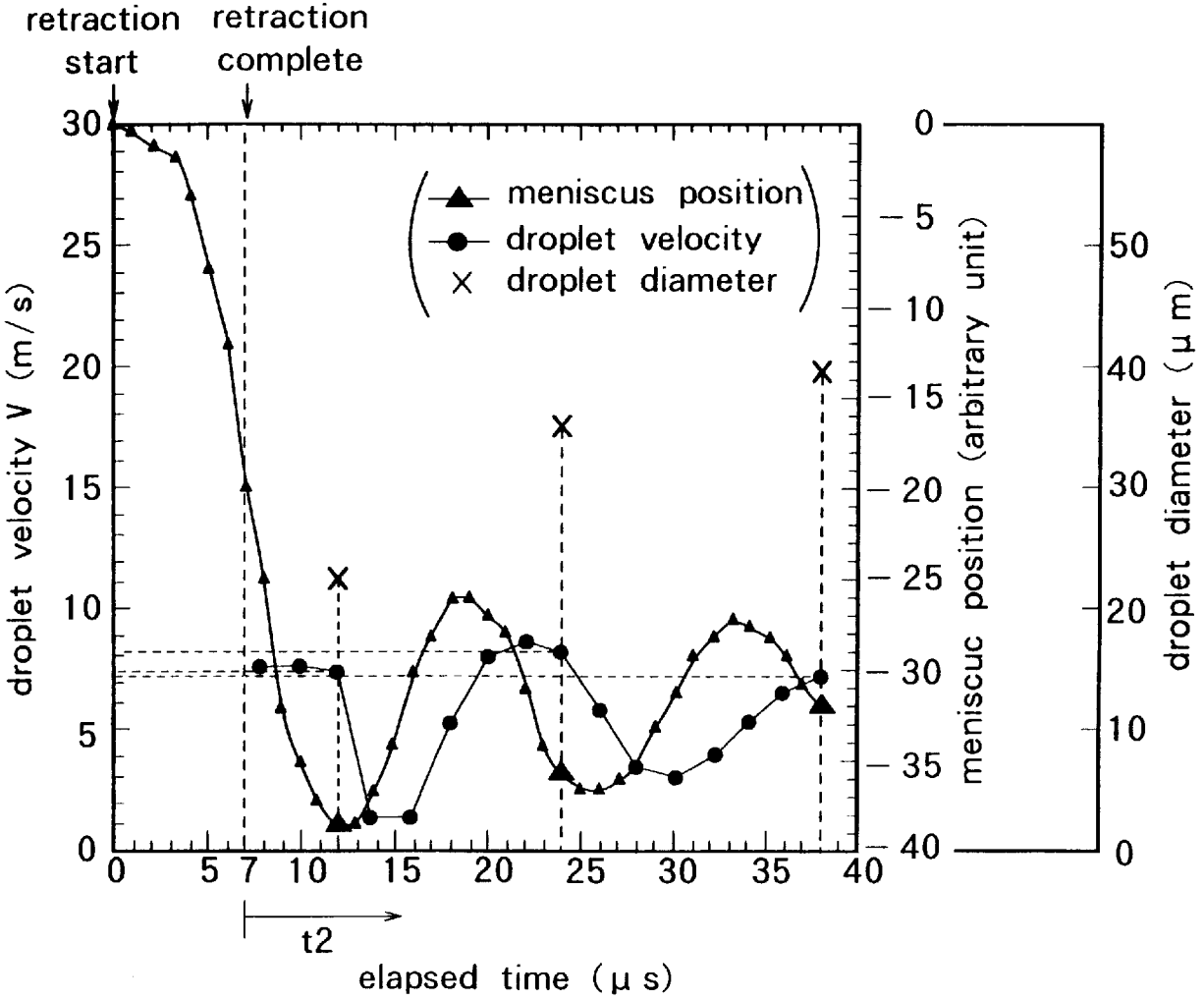
FIG. 22 shows the result in FIG. 21 overlaid on the result in FIG. 15.

Reference is now made to FIG. 21 and FIG. 22 showing the experiment results for describing the relationship between the intrinsic oscillations of meniscus and the size and velocity of ejected droplet.

FIG. 21 shows the result of measurement on variations in meniscus position and ejected droplet diameter with time t2 required for the second step (that is, time between the point of meniscus retraction in the first step and the start point of the third step for ejection) changed. The horizontal axis indicates time elapsed wherein the start point of the first step is zero in $\mu$sec. The vertical axis indicates the droplet diameter in addition to the meniscus position. In FIG. 21 black deltas (▲) indicate the meniscus positions. Crosses (X) indicate droplet diameters.

As previously described, FIG. 15 shows variations in velocity of ejected droplet with time t2 required for the second step changed.

FIG. 22 shows FIG. 21 overlaid on FIG. 15. The horizontal axis indicates time elapsed wherein the start point of the first step is zero. The vertical axis indicates the meniscus position and the size and velocity of ejected droplet obtained wherein the third step is started at each elapsed time. In FIG. 22 black deltas (▲) indicate the meniscus positions. Crosses (X) indicate droplet diameters. Black circles (●) indicate the velocities of ejected droplets.

As shown in FIG. 21, the deeper the meniscus position at the start point of the third step, the smaller the ejected droplet diameter is. For example, the droplet diameter is approximately 20 $\mu$m when the meniscus position is (−38). The droplet diameter is approximately 40 $\mu$m when the meniscus position is (−32). As shown in FIG. 15, the droplet velocity changes in a nearly constant oscillation cycle. Furthermore, as shown in FIG. 22, the droplet velocity is of the peak value if the third step is started at the instant when the meniscus position is shifted in the direction of retraction at the highest speed (at the point wherein the gradient of meniscus position displacement curve is of the negative peak value). In contrast, the droplet velocity is the minimum if the third step is started at the instant when the meniscus position is shifted in the direction of ejection at the highest speed (at the point wherein the gradient of meniscus position displacement curve is of the positive peak value). That is, the variation cycle of the ejected droplet velocity is equal to the cycle of meniscus displacement velocity and the phases thereof are shifted by approximately 180 degrees (that is, a half cycle) from each other. As shown in FIG. 22, the droplet diameters are of values different from one another at the three points (12, 24 and 38 μsec after the start point of retraction) when the droplet velocity is of nearly constant value (7 to 8 m/s). The droplet diameter increases with an increase in elapsed time.

Figures 23A, 23B, 23C, 23D:
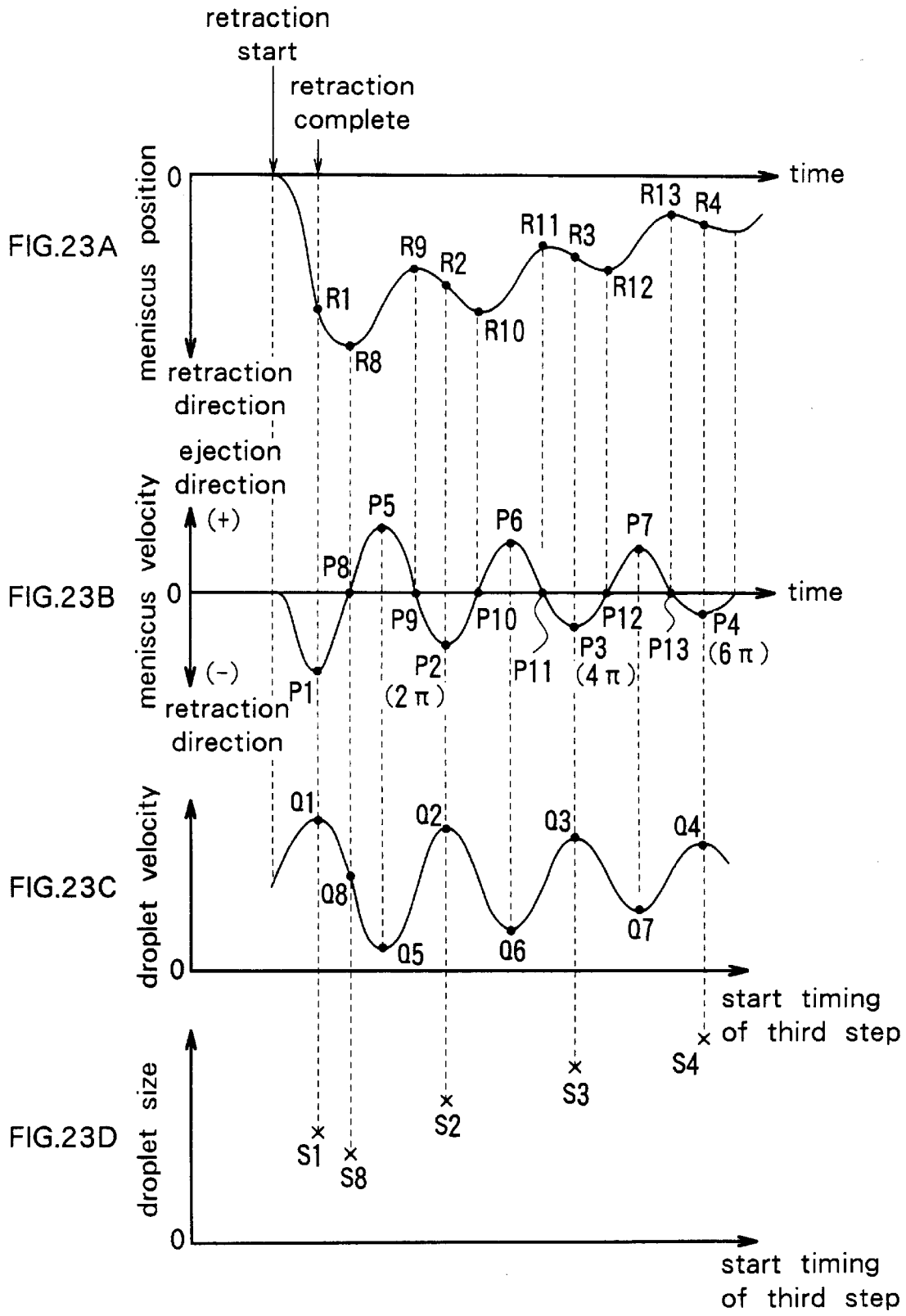
FIG. 23A to FIG. 23D illustrate the relationship among the meniscus position, meniscus velocity and droplet velocity.

The concept of the fact described so far will now be described, referring to FIG. 23A to FIG. 23D. FIG. 23A shows the meniscus position displacement curve with ink feed. FIG. 23B shows the meniscus position velocity curve obtained by differentiation of the meniscus position displacement curve in FIG. 23A. The horizontal axis indicates time and the vertical axis indicates the meniscus velocity. The velocity in the direction of ejection of droplet is indicated as (+) and the direction of meniscus retraction as (−). FIG. 23C shows the velocity of ejected droplet obtained when the third step is started at each point on the meniscus velocity curve in FIG. 23B. The horizontal axis indicates timing of the start of the third step and the vertical axis indicates the ejected droplet velocity. FIG. 23D shows the droplet sizes obtained when the third step is started at some points on the meniscus position velocity curve in FIG. 23B. The horizontal axis indicates timing of the start of the third step and the vertical axis indicates the droplet diameter. Both horizontal and vertical axes indicate the values in arbitrary units.

As shown in FIG. 23B, the meniscus velocity changes in an intrinsic oscillation cycle and the amplitude of change gradually attenuates. Corresponding to the meniscus velocity, as shown in FIG. 23C, the ejected droplet velocity changes in the same oscillation cycle as the meniscus velocity and the amplitude of change gradually attenuates. As described with reference to FIG. 22, the phase of change of ejected droplet velocity is shifted from the phase of change of meniscus velocity by nearly half a cycle. Therefore, the ejected droplet velocity is higher if ejection is performed when the meniscus position is shifted in the direction of retraction, compared to if ejection is performed when the meniscus position is shifted in the direction of ejection. Furthermore, the ejected droplet velocity increases with an increase in the velocity of shift in the direction of retraction. For example, if the third step is started at a point when the meniscus velocity is of the peak value in the direction of retraction (point P1, P2, P3 or P4, for example), the ejected droplet velocity is of the peak value (point Q1, Q2, Q3 or Q4, for example). In contrast, if the third step is started at a point when the meniscus velocity is of the peak value in the direction of ejection (point P5, P6 or P7, for example), the ejected droplet velocity is of the peak value (point Q5, Q6 or Q7, for example).

As thus described, the ejected droplet velocity directly relates to the meniscus velocity at the start point of the third step. As a result, the ejected droplet velocity is precisely controlled by appropriately determining or selecting the meniscus velocity at the start point of the third step. In particular, the ejected droplet velocity increases and maintains a constant value if the first step is started such that the start point of the third step corresponds to the point when the meniscus velocity is of the peak value in the direction of retraction (any of points P1, P2 and so on in FIG. 23B).

As described with reference to FIG. 22, the droplet size depends on the meniscus position at the start point of the third step. The deeper the meniscus position at which ejection is performed, the smaller the droplet size is. Therefore, for example, the meniscus positions at points such as Q1, Q2, Q3, Q4 and so on when the droplet velocities are each maximum change from a deeper position to a shallower position with time elapsed, as shown in FIG. 23A. Consequently, among the droplets ejected at these points, the size of droplet ejected at a later point is greater (S1 to S4 and so on in FIG. 23D). The droplet velocity is of intermediate value (Q8 in FIG. 23C) at point P8 when the meniscus velocity first reaches zero. The droplet size is minimum at the point since the meniscus position is deepest.

As thus described, the meniscus position after retraction in the first step changes while oscillating in an intrinsic cycle. The droplet size ejected depends on the meniscus position at the start point of the third step. The droplet velocity depends on the meniscus velocity at the start point of the third step. Therefore, the droplet size and velocity are precisely controlled as desired by appropriately determining (selecting) the meniscus position and velocity at the start point of the third step with the intrinsic oscillation of the meniscus position taken into account.

As described above, the ejected droplet size changes depending on the meniscus position at the start point of the third step. The meniscus position at the start point of the third step depends on the amount of retraction in the first step. That is, the meniscus position at the start point of the third step is selected as desired by changing the amount of retraction in the first step if time between the completion of retraction in the first step and the start of the third step (time t2 required for the second step) is constant. On the other hand, the droplet velocity changes depending on the meniscus velocity at the start point of the third step as described above. The amplitude of meniscus velocity changes depending on the amount of retraction in the first step. Therefore, if time between the point when retraction in the first step is completed and the start point of the third step is constant, the meniscus velocity at the start point of the third step is selected as desired by changing the amount of retraction in the first step. The size and velocity of ejected droplet are thus controlled by changing the amount of retraction in the first step. This fact will be further described, referring to FIG. 24A to FIG. 24C.

Figure 24A:
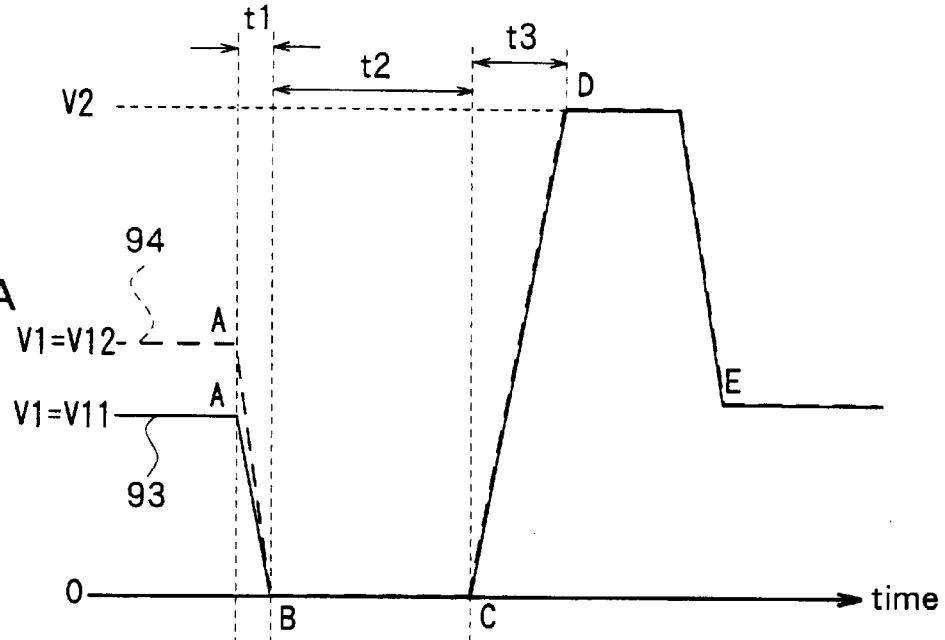
FIG. 24A to FIG. 24C illustrate a drive method of a recording head for an ink-jet printer of a seventh embodiment of the invention and particularly show the shifts of meniscus position and meniscus velocity when the retraction voltage in the first step is only varied.
Figure 24B:
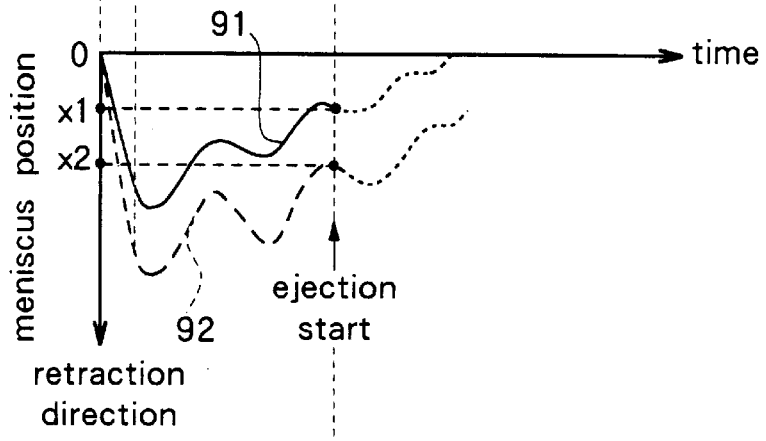
Figure 24C:
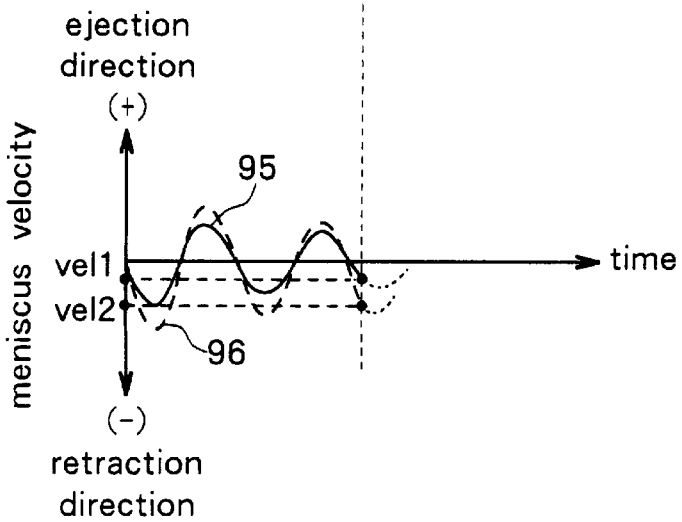

FIG. 24A to FIG. 24C show the shifts of meniscus position and meniscus velocity when retraction voltage V1 in the first step is varied while time t2 required for the second step is kept constant. FIG. 24A shows the voltage waveform of the head drive signal wherein the horizontal axis indicates time and the vertical axis indicates voltage. FIG. 24B shows the shifts of meniscus position wherein the horizontal axis indicates time and the vertical axis indicates the meniscus position (the distance between the nozzle edge and the meniscus). FIG. 24C shows the changes of meniscus velocity wherein the horizontal axis indicates time and the vertical axis indicates the meniscus velocity.

A locus 91 of the meniscus position in solid line and a curve 95 indicating changes of meniscus velocity correspond to a voltage waveform 93 wherein the retraction voltage is lower (V1=V11). A locus 92 of the meniscus position in broken line and a curve 96 indicating changes of meniscus velocity correspond to a voltage waveform 94 wherein the retraction voltage is higher (V1=V12). In this description time t3 required for the third step and ejection voltage V2 are constant as described above. Time t1 required for the first step is constant, which may be variable if necessary.

As shown, the meniscus is deeply retracted with a higher retraction voltage. Since the ink feed speed is constant, the mean advance speed of meniscus (the mean value of gradients of the loci 91 and 92 of the meniscus moving towards the nozzle edge while oscillating in FIG. 24B) is constant. Consequently, as shown in FIG. 24B, the meniscus positions at the start point of ejection (point C at which the third step is started) are different with time t2 constant. In the example shown, the meniscus position at point C is as deep as x2 with higher retraction voltage V1. The meniscus position at point C is as shallow as x1 with lower retraction voltage V1. That is, the meniscus position at point C at which the third step is started is changed by changing the magnitude of retraction voltage V1.

As shown in FIG. 24B, the amplitude of the locus 92 when retraction voltage V1 is higher is greater than that of the locus 91 when retraction voltage V1 is lower. The cycle of shifts of meniscus position is constant. Therefore, the maximum gradient of the locus 92 is greater than that of the locus 91. Consequently, the amplitude of a curve 96 indicating changes of meniscus velocity is greater than that of a curve 95 as shown in FIG. 24C. Accordingly, if time t2 required for the second step (that is, time between point B at which retraction is completed and point C at which the third step is started) is constant, the meniscus velocity at point C at which the third step is started varies. In the example shown in FIG. 24A to FIG. 24C, velocity vel2 is obtained which is greater in the direction of retraction when retraction voltage V1 is high. Velocity vel1 is obtained which is smaller in the direction of retraction when retraction voltage V1 is low. That is, the meniscus velocity at point C at which the third step is started is changed by changing the magnitude of retraction voltage V1.

As a result, both size and velocity of ejected droplet are controlled by changing retraction voltage V1 in the first step while keeping time t2 required for the second step constant.

Figure 25:
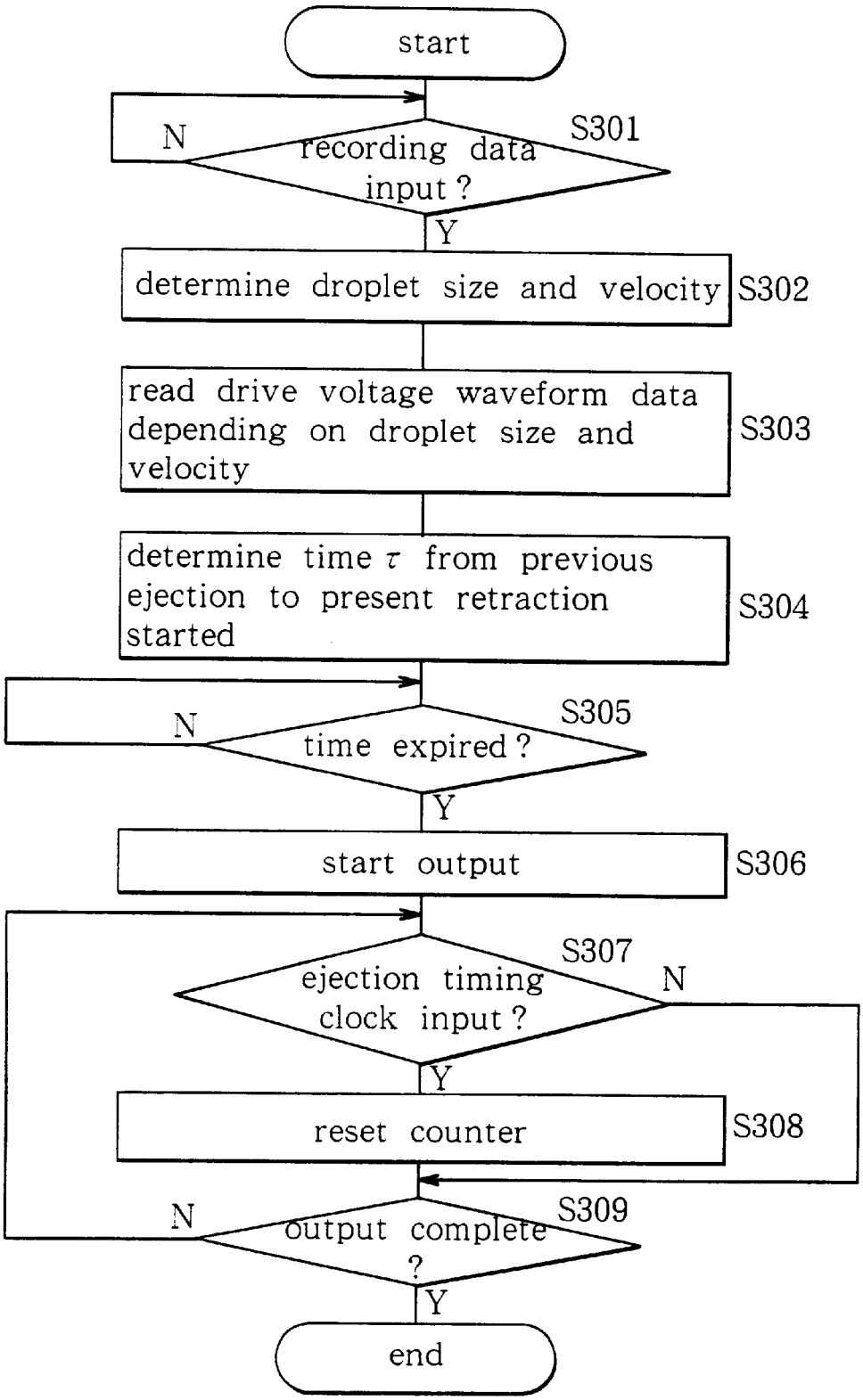
FIG. 25 is a flowchart for illustrating the operation of main control unit of the head controller.

Referring to FIG. 25, the operation of the ink-jet printer 1 as a whole of the embodiment will now be described. FIG. 25 shows the main operation of one ejection cycle in the head controller 14 in FIG. 1. In this description the counter 145 (FIG. 4) in the head controller 14 is already reset in the immediately preceding ejection cycle. Voltage V1 at point I (FIG. 5) at which ejection is completed in the immediately preceding cycle is maintained until a head drive signal is outputted in step S306 in FIG. 25.

In FIG. 1 printing data is inputted to the ink-jet printer 1 from an information processing apparatus such as a personal computer. The image processor 15 performs specific image processing on the input data (such as expansion of compressed data) and outputs the data as recording data to the head controller 14.

On receipt of the recording data (Y in step S301 in FIG. 25), the main control section 141 (FIG. 4) in the head controller 14 determines (selects) a size and velocity of ink droplet to be ejected for forming a specific dot based on the data (step S302).

For example, a large droplet size is selected for representing high density and a small size for representing low density or high resolution. For representing a natural image or an image with density gradient, a droplet size different from neighboring dots is selected if necessary.

For example, if the travel velocity of the recording head 11 slightly changes depending on the position on a stroke, the droplet velocity is determined in accordance with the coordinate of each dot along the stroke so as to compensate the error in recording head velocity. For example, if the carriage travel velocity of the recording head 11 is lower at both ends compared to the center, it is determined that the droplet velocity is lower at both ends and higher in the center. If it is ensured that the travel velocity of the recording head 11 is precisely constant regardless of the position on a stroke, the droplet velocity is determined to be constant. In these cases, the absolute value of droplet velocity is predetermined, taking the distance between the recording head 11 and paper and other conditions into consideration.

Next, the main control section 141 reads drive voltage waveform data corresponding to the selected droplet velocity from the storage section 144 (step S303). As described with reference to FIG. 4, waveform data in various forms corresponding to droplet sizes and velocities is stored in the storage section 144. In the embodiment, waveform data is read, having retraction voltage V1 corresponding to the selected droplet size and velocity, for each dot when the droplet size and velocity are changed depending on the position of the recording head 11 as mentioned above. In order to control the droplet size and velocity to be constant, one type of predetermined waveform data is only read repeatedly for every dot.

Next, the main control section 141 determines time $\tau$ between point H at which the third step in the previous cycle is started (that is, the point of ejection at which the counter 145 is reset and counting is started) and point A at which retraction in the present cycle is started (the start point of the first step) based on the read waveform data (step S304). As shown in FIG. 5A, time $\tau$ is given by subtracting the sum of time required for the first and second steps (t1+t2) from interval T between ejections (the cycle of ejection timing clock). The operations in steps S301 to S304 described so far are performed in a short time between point I and point A in FIG. 5A. If voltage V1 in the waveform data read in the present cycle (that is, the voltage at point A) is different from the voltage at point I in the previous ejection cycle, the value of voltage V1 applied to the piezoelectric element 122 is changed to the value read in the present cycle and the value is maintained.

Next, the main control section 141 waits until time $\tau$ expires (step S305). Time $\tau$ having expired, an expiration signal is inputted from the counter 145 (Y in step S305). The main control section 141 then starts outputting the read waveform data (step S306). The waveform data is converted to an analog signal at the D-A converter 146 and amplified at the amplifier 147 to be supplied to the recording head 11 as a head drive signal with a waveform as A to E in FIG. 5A, for example. In the recording head 11, the three steps described with reference to FIG. 5A to FIG. 5C are performed based on the voltage waveform of the head drive signal. An ink droplet with the velocity as determined by the waveform data is thus ejected. In the period after point E, preparation for next ejection cycle is performed, that is, the droplet velocity is determined and the waveform data is read and so on (steps S301 to S304). Such ejection and preparation for ejection are repeated.

After the head drive signal is started to be outputted in step S306, an ejection timing clock is inputted at point C at which the third step is started (Y in step S307). The counter 145 is reset and start counting for next ejection cycle (step S308). The third step is completed at point D in FIG. 5A (step S309). Voltage V1 is maintained or changed as described above and maintained after the drive voltage is returned to V1 at point E until point F at which next ejection cycle is started. During this period the ink chamber 113 is refilled with ink to prepare for next ejection. The one ejection cycle is thus completed.

In the embodiment as described so far, the three steps are performed for ink ejection, including the first step in which the meniscus is retracted with retraction voltage V1; the second step in which ink is fed while the drive voltage is maintained at zero and the meniscus position is moved forward; and the third step in which ejection voltage V2 is applied in accordance with the meniscus velocity shifting in an intrinsic oscillation cycle and an ink droplet is ejected. The meniscus position and velocity at the start of ejection are determined as desired by changing retraction voltage V1 in the first step. The size and velocity of ejected droplet are thereby changed as desired. It is possible to precisely maintain the droplet size and velocity constant by fixing retraction voltage V1.

Although time t3 required for the third step (that is, the contraction speed of the ink chamber 113) and the magnitude of ejection voltage V2 (that is, the amount of contraction of the ink chamber 113) are constant in the foregoing description, these parameters may be varied. In general the droplet size and velocity change as well, depending on ejection voltage V2 in the third step and time t3. For example, the droplet size is increased with an increase in ejection voltage V2. The droplet velocity is increased with a reduction in time t3. Therefore, the variety of controls is increased by controlling the parameters (V2 and t3) together with retraction voltage V1. The range of droplet size and velocity may be thus increased as well.

The invention is not limited to the foregoing embodiments but may be practiced in still other ways. For example, although the voltage is maintained at 0 V in the second step while retraction voltage V1 in the first step and ejection voltage V3 in the third step are voltages of the same polarity in the foregoing embodiments, retraction voltage V1 may be 0 V while the voltage maintained in the second step and ejection voltage V3 are voltages of the reverse polarities.

In the foregoing embodiments, waveform data is read into the main control section 141 in the head controller 14 from the storage section 144. Based on the data, a head drive signal is generated and outputted for obtaining the specified droplet size and velocity. Instead of such control implemented through software, the invention may be carried out with hardware for generating a head drive signal through the use of a logic circuit.

Although ink is continuously fed to the ink chamber 113 at a constant speed, ink may be fed only in the period of the second step and the refill period after the third step is completed. In addition, a pressure mechanism may be provided for the ink cartridge 12 for pressure control so as to change the ink feed speed in the second step from that in the refill period after the third step is completed.

Obviously many modifications and variations of the present invention are possible in the light of the above teachings. It is therefore to be understood that within the scope of the appended claims the invention may be practiced otherwise than as specifically described.

What is claimed is:

1. An ink-jet printer comprising:

a droplet outlet orifice through which an ink droplet is ejected;

an ink chamber in fluid communication with the outlet orifice;

an ink feed duct for feeding ink to the ink chamber;

a piezoelectric element for expanding and contracting the ink chamber in response to an applied voltage; and step control means for controlling a first step of retracting an extremity of ink exposed to an outside region through the outlet orifice towards the ink chamber by expanding the ink chamber with the piezoelectric element, a second step of moving the ink extremity towards the outlet orifice by maintaining constant a volume of the ink chamber and feeding ink to the ink chamber through the ink feed duct, and a third step of ejecting an ink droplet through the outlet orifice by contracting the ink chamber with the piezoelectric element, wherein the step control means controls a size of the ink droplet ejected in the third step by controlling a position of the ink extremity at a start point of the third step through changing at least either an amount of retraction of the ink extremity in the first step or a time required for the second step.

2. An ink-jet printer according to claim 1, wherein the step control means controls the size of the ink droplet by controlling an amount of contraction of the ink chamber in the third step.

3. An ink-jet printer according to claim 1, wherein the step control means controls the position of the ink extremity at the start point of the third step by changing an amount of retraction of the ink extremity in the first step while keeping the time required for the second step constant.

4. An ink-jet printer according to claim 1, wherein the step control means controls the position of the ink extremity at the start point of the third step by changing the time required for the second step while keeping an amount of retraction of the ink extremity in the first step constant.

5. An ink-jet printer according to claim 1, wherein the step control means controls the position of the ink extremity at the start point of the third step by changing an amount of retraction of the ink extremity in the first step and the time required for the second step.

6. A drive method for driving a recording head of an ink-jet printer comprising a droplet outlet orifice through which an ink droplet is ejected, an ink chamber in fluid communication with the outlet orifice, an ink feed duct for feeding ink to the ink chamber, and a piezoelectric element for expanding and contracting the ink chamber in response to an applied voltage, the method comprising the steps of:

retracting an extremity of ink exposed to an outside region through the outlet orifice towards the ink chamber by expanding the ink chamber with the piezoelectric element;

moving the ink extremity towards the outlet orifice by maintaining constant a volume of the ink chamber and feeding ink to the ink chamber through the ink feed duct; and ejecting an ink droplet through the outlet orifice by contracting the ink chamber with the piezoelectric element, wherein a size of the ejected ink droplet is controlled by controlling a position of the ink extremity at a start point of the ejecting step through changing at least either an amount of retraction of the ink extremity in the retracting step or a time required for the moving step.

7. A drive method according to claim 6, wherein the size of the ink droplet is controlled by controlling an amount of contraction of the ink chamber in the ejecting step.

8. A drive method according to claim 6, wherein the position of the ink extremity at the start point of the ejecting step is controlled by changing the amount of retraction of the ink extremity in the retracting step while keeping the time required for the moving step constant.

9. A drive method according to claim 6, wherein the position of the ink extremity at the start point of the ejecting step is controlled by changing the time required for the moving step while keeping the amount of retraction of the ink extremity in the retracting step constant.

10. A drive method according to claim 6, wherein the position of the ink extremity at the start point of the ejecting step is controlled by changing the amount of retraction of the ink extremity in the retracting step and the time required for the moving step.

11. An ink-jet printer comprising:

a droplet outlet orifice through which an ink droplet is ejected;

an ink chamber in fluid communication with the outlet orifice;

an ink feed duct for feeding ink to the ink chamber;

a piezoelectric element for expanding and contracting the ink chamber in response to an applied voltage; and step control means for controlling a first step of retracting an extremity of ink exposed to an outside region through the outlet orifice towards the ink chamber by expanding the ink chamber with the piezoelectric element, a second step of moving the ink extremity towards the outlet orifice by maintaining constant a volume of the ink chamber and feeding ink to the ink chamber through the ink feed duct, and a third step of ejecting an ink droplet through the outlet orifice by contracting the ink chamber with the piezoelectric element, wherein the step control means controls a velocity of the ink droplet ejected in the third step by controlling a velocity of periodic travel of the ink extremity at a start point of the third step.

12. An ink-jet printer according to claim 11, wherein the step control means controls the velocity of the ink droplet by controlling a velocity of contraction of the ink chamber in the third step.

13. An ink-jet printer according to claim 11, wherein the step control means controls the velocity of periodic travel of the ink extremity at the start point of the third step by changing an amount of retraction of the ink extremity in the first step while keeping a time required for the second step constant.

14. An ink-jet printer according to claim 11, wherein the step control means controls the velocity of periodic travel of the ink extremity at the start point of the third step by changing a time required for the second step while keeping an amount of retraction of the ink extremity in the first step constant.

15. An ink-jet printer according to claim 11, wherein the step control means controls the velocity of periodic travel of the ink extremity at the start point of the third step by changing an amount of retraction of the ink extremity in the first step and a time required for the second step.

16. An ink-jet printer according to claim 11, wherein the step control means controls the first, second, and third steps so that the velocity of periodic travel of the ink extremity at the start point of the third step is constant.

17. An ink-jet printer according to claim 11, wherein the step control means controls the velocity of periodic travel of the ink extremity at the start point of the third step by controlling a phase of the velocity of periodic travel of the ink extremity at the start point of the third step.

18. An ink-jet printer according to claim 17, wherein the step control means keeps the velocity of periodic travel of the ink extremity at the start point of the third step constant by keeping the phase of the velocity of periodic travel of the ink extremity at the start point of the third step constant.

19. A drive method for driving a recording head of an ink-jet printer comprising a droplet outlet orifice through which an ink droplet is ejected, an ink chamber in fluid communication with the outlet orifice, an ink feed duct for feeding ink to the ink chamber, and a piezoelectric element for expanding and contracting the ink chamber in response to an applied voltage, the method comprising the steps of:

retracting an extremity of ink exposed to an outside region through the outlet orifice towards the ink chamber by expanding the ink chamber with the piezoelectric element;

moving the ink extremity towards the outlet orifice by maintaining constant a volume of the ink chamber and feeding ink to the ink chamber through the ink feed duct; and ejecting an ink droplet through the outlet orifice by contracting the ink chamber with the piezoelectric element, wherein a velocity of the ink droplet ejected in the ejecting step is controlled by controlling a velocity of periodic travel of the ink extremity at a start point of the ejecting step.

20. A drive method according to claim 19, wherein the velocity of the ink droplet is controlled by controlling a velocity of contraction of the ink chamber in the ejecting step.

21. A drive method according to claim 19, wherein the velocity of periodic travel of the ink extremity at the start point of the ejecting step is controlled by changing an amount of retraction of the ink extremity in the retracting step while keeping a time required for the moving step constant.

22. A drive method according to claim 19, wherein the velocity of periodic travel of the ink extremity at the start point of the ejecting step is controlled by changing a time required for the moving step while keeping an amount of retraction of the ink extremity in the retracting step constant.

23. A drive method according to claim 19, wherein the velocity of periodic travel of the ink extremity at the start point of the ejecting step is controlled by changing an amount of retraction of the ink extremity in the retracting step and a time required for the moving step.

24. A drive method according to claim 19, wherein the retracting, moving, and ejecting steps are controlled so that the velocity of periodic travel of the ink extremity at the start point of the ejecting step is constant.

25. A drive method according to claim 19, wherein the velocity of periodic travel of the ink extremity at the start point of the ejecting step is controlled by controlling a phase of the velocity of periodic travel of the ink extremity at the start point of the ejecting step.

26. A drive method according to claim 25, wherein the velocity of periodic travel of the ink extremity at the start point of the ejecting step is kept constant by keeping the phase of the velocity of periodic travel of the ink extremity at the start point of the ejecting step constant.

27. An ink-jet printer comprising:

a droplet outlet orifice through which an ink droplet is ejected;

an ink chamber in fluid communication with the outlet orifice;

an ink feed duct for feeding ink to the ink chamber;

a piezoelectric element for expanding and contracting the ink chamber in response to an applied voltage; and step control means for controlling a first step of retracting an extremity of ink exposed to an outside region through the outlet orifice towards the ink chamber by expanding the ink chamber with the piezoelectric element, a second step of moving the ink extremity towards the outlet orifice by maintaining constant a volume of the ink chamber and feeding ink to the ink chamber through the ink feed duct, and a third step of ejecting an ink droplet through the outlet orifice by contracting the ink chamber with the piezoelectric element, wherein the step control means controls a size and a velocity of the ink droplet ejected in the third step by controlling a position and a velocity of periodic travel of the ink extremity at a start point of the third step.

* * * * *